US009411271B2

(12) United States Patent
Matsushita

(10) Patent No.: US 9,411,271 B2
(45) Date of Patent: Aug. 9, 2016

(54) IMAGE FORMING APPARATUS TO SET TARGET CURRENTS

(71) Applicant: CANON KABUSHIKI KAISHA, Tokyo (JP)

(72) Inventor: Mio Matsushita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/716,636

(22) Filed: May 19, 2015

(65) Prior Publication Data

US 2015/0338791 A1 Nov. 26, 2015

(30) Foreign Application Priority Data

May 23, 2014 (JP) ..... 2014-107613

(51) Int. Cl.
*G03G 15/16* (2006.01)
*G03G 15/00* (2006.01)

(52) U.S. Cl.
CPC ..... *G03G 15/1615* (2013.01); *G03G 15/80* (2013.01)

(58) Field of Classification Search
CPC ..... G03G 15/1675
See application file for complete search history.

(56) References Cited

U.S. PATENT DOCUMENTS

2002/0006294 A1* 1/2002 Yano ..... G03G 15/1685 399/310
2006/0210322 A1* 9/2006 Watanabe ..... G03G 15/0121 399/299

FOREIGN PATENT DOCUMENTS

JP 2-123385 A 5/1990
JP 2008-129471 A 6/2008
JP 2010-72074 A 4/2010
JP 2011-65024 A 3/2011

* cited by examiner

*Primary Examiner* — Clayton E Laballe
*Assistant Examiner* — Victor Verbitsky
(74) *Attorney, Agent, or Firm* — Canon USA, Inc. IP Division

(57) ABSTRACT

An image forming apparatus includes a control portion that controls, before performing continuous image formation on a plurality of transfer materials, a voltage to be applied to a primary transfer member for primary transfer during the continuous image formation, and a correction unit that corrects the primary transfer voltage during the continuous image formation. The correction unit can perform a first mode for controlling the primary transfer voltage according to a target value determined by the control portion, and a second mode for changing the target value and controlling the primary transfer voltage according to the changed value. The control portion performs the first mode if a detected electric resistance is a first value or lower, or a second value, greater than the first value, or higher, and performs the second mode if the resistance is higher than the first value and lower than the second value.

12 Claims, 14 Drawing Sheets

IMAGE FORMING APPARATUS TO SET TARGET CURRENTS

BACKGROUND OF THE INVENTION

1. Field of the Invention

The present invention relates to an image forming apparatus, such as a copying machine, a printer, and a facsimile apparatus, which uses an electrophotographic process or an electrostatic recording process.

2. Description of the Related Art

Recently, full color machines capable of outputting a plurality of colors have become the mainstream of electrophotographic and electrostatic recording image forming apparatuses. For example, many tandem type image forming apparatuses, in which a plurality of image bearing members of different developing colors is arranged along a rotation path of an intermediate transfer member to form a full color image, have been put to practical use.

Generally speaking, in electrophotographic and electrostatic recording image forming apparatuses, the electric resistances of an intermediate transfer member and transfer rollers and/or the thicknesses of surface layers of photosensitive members may change with a change in an atmospheric environment such as temperature and humidity, or with the use of the apparatuses. Thus, according to such changes, it is desirable to change a transfer voltage to be applied to a transfer member. To obtain a desired transfer voltage during an image forming operation, a voltage determination control for determining a control value (voltage value) for constant voltage control is performed before the image forming operation. For example, Japanese Patent Application Laid-Open No. 2-123385 discusses active transfer voltage control (ATVC) as a voltage determination method. In the ATVC, a desired constant current voltage is applied to a photosensitive member from a transfer roller during a non-image forming operation of the image forming apparatus, and the value of the voltage applied at that time is stored. The electric resistance of the transfer member is thereby detected, and a constant voltage according to the electric resistance value is applied to the transfer roller as a transfer voltage at the time of transfer in the image-forming operation.

Further, it is desirable that an image forming apparatus that performs continuous image formation change the transfer voltage applied to a transfer member, according to a change in the atmospheric environment inside the apparatus due to the continuous operation. Thus, sheet-to-sheet correction control may be performed to correct a primary transfer voltage value. The sheet-to-sheet correction control includes monitoring a primary transfer current at a timing corresponding to an interval between transfer materials during the continuous image formation (hereinafter also referred to as "an interval between sheets"), and increasing or decreasing the applied voltage by a certain value if a difference equal to or greater than a certain current amount occurs with respect to a target current.

Japanese Patent Application Laid-Open No. 2008-129471 discusses a method for enabling optimum constant voltage settings even under extreme conditions when the present electric resistance of a transfer member changes greatly due to a temporal change or temperature variations. More specifically, a target transfer current value is set based on a predetermined table according to the electric resistance of the transfer member obtained during the foregoing ATVC. The table contains values that are set in advance to uniquely reduce the target transfer current value as the electric resistance increases.

However, the foregoing conventional method by which the target transfer current value is determined according to the electric resistance obtained in the voltage determination control performed before the image formation may fail to apply an appropriate transfer voltage during the image formation.

In particular, if an intermediate transfer member of which the electric resistance changes greatly during the image formation is used, the optimum current varies during the image formation. As a result, the current value determined according to the electric resistance obtained before the image formation deviates gradually from the optimum current if a large amount of images are formed.

Furthermore, if the foregoing conventional control of uniquely reducing the target transfer current value with an increase in the electric current is used with an intermediate transfer member of which the electric resistance changes greatly during the image formation, the following problem may occur. If the electric resistance of the intermediate transfer member is low, the target transfer current value becomes high and an excessive current may flow through the photosensitive member, thereby causing a memory in the photosensitive member. On the other hand, if the electric resistance of the intermediate transfer member is high, the target transfer current value may be lowered too much, thereby causing a transfer defect.

SUMMARY OF THE INVENTION

According to an aspect of the present invention, an image forming apparatus includes an image bearing member configured to bear a toner image thereon, a movable intermediate transfer member configured to temporarily bear the toner image, the toner image being transferred from the image bearing member onto the intermediate transfer member in a transfer portion and then being transferred onto a recording material, a transfer member configured to electrostatically transfer the toner image formed on the image bearing member onto the intermediate transfer member in the transfer portion, a power supply configured to apply a voltage to the transfer member, a detection member configured to detect a current flowing through the transfer member during the application of the voltage to the transfer member, a control portion configured to control the voltage of the power supply in such a way that the current detected by the detection member has a predetermined target current value during continuous image formation, and a setting portion configured to, during the control of the voltage of the power supply by the control portion, (a) set the target current value to a first current value, in a case of a value related to an electric resistance obtained through the detection by the detection member being a first value or lower, (b) set the target current value to a correction current value based on the value related to the electric resistance, in a case of the value related to the electric resistance being greater than the first value and lower than a second value greater than the first value, and (c) set the target current value to a second current value lower than the first current value, in a case of the value related to the electric resistance being the second value or greater.

Further features of the present invention will become apparent from the following description of exemplary embodiments with reference to the attached drawings.

DESCRIPTION OF THE EMBODIMENTS

An image forming apparatus according to an exemplary embodiment of the present invention will be described in detail below with reference to the drawings.

1. Overall Configuration and Operation of Image Forming Apparatus

Figure 1:
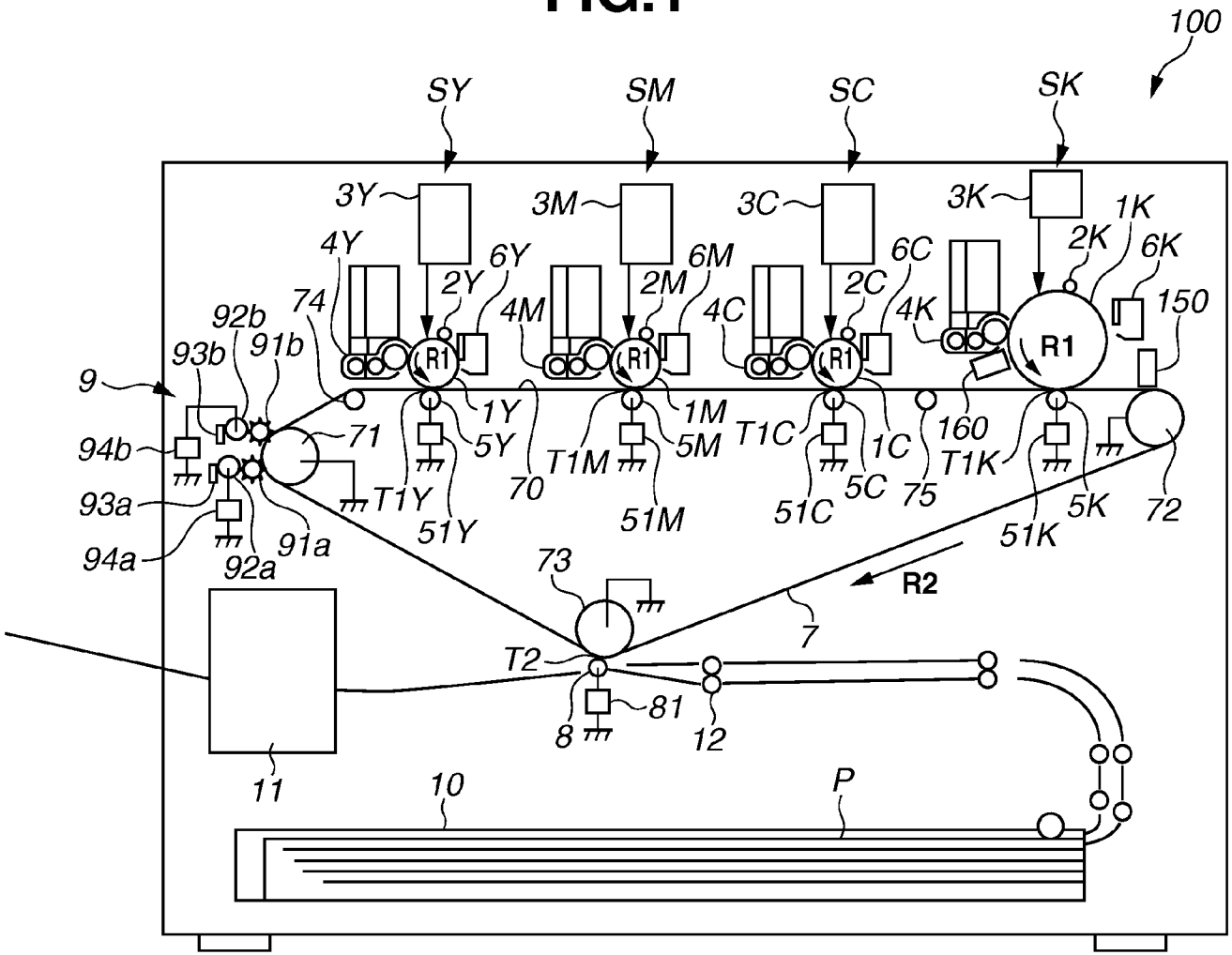
FIG. 1 is a schematic sectional view of an image forming apparatus (in a full color mode).

FIG. 1 is a schematic sectional view of an image forming apparatus according to a first exemplary embodiment of the present invention. The image forming apparatus 100 according to the present exemplary embodiment is a tandem type laser beam printer using an intermediate transfer system, which is capable of forming a full color image on a transfer material (such as a recording sheet, an overhead projector (OHP) sheet, and cloth) through an electrophotographic process.

The image forming apparatus 100 includes first, second, third, and fourth image forming units SY, SM, SC, and SK as a plurality of image forming units (stations). The image forming units SY, SM, SC, and SK form an image of yellow (Y), magenta (M), cyan (C), and black (K), respectively. In the present exemplary embodiment, the image forming units SY, SM, SC, and SK have a lot in common in terms of configuration and operation, except that each of the units uses toner of a different color. Therefore, in the following description, the suffixes "Y", "M", "C", and "K" on image forming units S to indicate the elements provided for the respective colors will be omitted and the elements will be described in a generalized manner unless a distinction is particularly needed.

The image forming units S each include a photosensitive drum 1, which is a drum-shaped (cylindrical) electrophotographic photosensitive member (photosensitive member) serving as an image bearing member arranged in a rotatable manner. The photosensitive drum 1 is driven to rotate by a drive motor (not illustrated) serving as a drive unit in a direction indicated by an arrow R1 in FIG. 1. Around the photosensitive drum 1, process devices are arranged, including a charging roller 2 serving as a charging unit, an exposure device 3 serving as an exposure unit, a developing device 4 serving as a developing unit, and a drum cleaning device 6 serving as a photosensitive member cleaning unit. The developing devices 4 of the image forming units SY, SM, SC, and SK store toner of yellow, magenta, cyan, and black, respectively. In the present exemplary embodiment, the photosensitive drum 1K of the fourth image forming unit SK has a diameter greater than those of the other image forming units SY, SM, and SC. The fourth image forming unit SK also includes a sensor for detecting the density of a patch (described below).

An intermediate transfer belt 7 constituting an endless belt serving as an intermediate transfer member is arranged to be opposed to the photosensitive drums 1 of the image forming units S. The intermediate transfer belt 7 is held by support members (stretching rollers) including a driving roller 71, a tension roller 72, a secondary transfer counter roller 73, and push-up rollers 74 and 75. The driving roller 71 transmits drive to the intermediate transfer belt 7. The tension roller 72 applies a predetermined tension to the intermediate transfer belt 7. The secondary transfer counter roller 73 serves as a counter member (counter electrode) of a secondary transfer roller 8 to be described below. The push-up rollers 74 and 75 form a primary transfer plane 70 for transferring a toner image onto the intermediate transfer belt 7. The four image forming units SY, SM, SC, and SK are arranged in line along a horizontal portion of the primary transfer plane 70. The driving roller 71 is driven to rotate at a circumferential speed of 350 mm/sec by a drive motor (not illustrated) serving as a drive unit such as a pulse motor. Consequently, the intermediate transfer belt 7 rotates (circulates) in a direction indicated by an arrow R2 in FIG. 1 (hereinafter also referred to as "rotation direction" or "conveyance direction"). The stretching rollers other than the driving roller 71 are driven to rotate by the rotation of the intermediate transfer belt 7.

On the inner peripheral (back surface) side of the intermediate transfer belt 7, primary transfer rollers 5 are arranged in positions opposed to the photosensitive drums 1 of the respective image forming units S. The primary transfer rollers 5 each are a primary transfer member having a roller shape serving as a primary transfer unit. Each of the primary transfer rollers 5 is biased (pressed) toward the photosensitive drum 1 via the intermediate transfer belt 7 to form a primary transfer portion (primary transfer nip) T1 where the intermediate transfer belt 7 and the photosensitive drum 1 make contact with each other. The secondary transfer roller 8 is arranged in a position opposed to the secondary transfer counter roller 73 on the outer peripheral (front surface) side of the intermediate transfer belt 7. The secondary transfer roller 8 is a secondary transfer member having a roller shape serving as a secondary transfer unit. The secondary transfer roller 8 is biased (pressed) toward the secondary transfer counter roller 73 via the intermediate transfer belt 7 to form a secondary transfer portion (secondary transfer nip) T2 where the intermediate transfer belt 7 and the secondary transfer roller 8 make contact with each other. A belt cleaning device 9 serving as an intermediate transfer member cleaning unit is also arranged in a position opposed to the driving roller 71 on the outer peripheral side of the intermediate transfer belt 7.

Each of the rotating photosensitive drums 1 is uniformly charged by the charging roller 2. The charged photosensitive drum 1 is exposed by the exposure device 3 according to image information, whereby an electrostatic latent image (electrostatic image) according to the image information is formed thereon. The developing device 4 supplies toner of a color corresponding to the image forming unit S, whereby the electrostatic latent image formed on the photosensitive drum 1 is developed as a toner image. The toner image formed on the photosensitive drum 1 is primarily transferred onto the rotating intermediate transfer belt 7 in the primary transfer portion T1 by the action of the primary transfer roller 5. At this time, a primary transfer power supply 51 serving as an application unit applies a primary transfer bias (primary transfer voltage) to the primary transfer roller 5, whereby a primary transfer field is formed in the primary transfer portion T1. The primary transfer bias is a direct-current voltage of opposite polarity to the charging polarity (normal charging polarity) of the toner at the time of development. In the present exemplary embodiment, primary transfer power supplies 51Y, 51M, 51C, and 51K are connected to the primary transfer rollers 5Y, 5M, 5C, and 5K of the image forming units SY, SM, SC, and SK, respectively. For example, during formation of a full color image, toner images of the respective colors, yellow, magenta, cyan, and black that are formed by the respective image forming units S are successively transferred onto the intermediate transfer belt 7 in an overlapping manner in the respective primary transfer portions T1.

The toner images transferred to the intermediate transfer belt 7 are secondarily transferred onto a transfer material P in the secondary transfer portion T2 by the action of the secondary transfer roller 8. At this time, a secondary transfer power supply 81 serving as an application unit applies a secondary transfer bias (secondary transfer voltage) to the secondary transfer roller 8, whereby a secondary transfer field is formed in the secondary transfer portion T2. The secondary transfer bias is a direct-current voltage of a polarity opposite to a normal charging polarity of a toner. By this time, the transfer material P is fed out of a sheet cassette 10, temporarily stopped by a registration roller 12, and then conveyed to the secondary transfer portion T2 at a predetermined timing. The transfer material P to which the toner images have been transferred is conveyed to a fixing device 11. In the fixing device 11, the toner images are firmly fixed to the transfer material P by heat and pressure. The transfer material P is then discharged (output) to the outside of the main body of the image forming apparatus 100.

Residual transfer toner on the photosensitive drum 1, which was not transferred onto the intermediate transfer belt 7 during the primary transfer, is removed and collected from the photosensitive drum 1 by the drum cleaning device 6. Residual transfer toner on the intermediate transfer belt 7, which was not transferred onto the transfer material P during the secondary transfer, is removed and collected from the intermediate transfer belt 7 by the belt cleaning device 9.

2. Configuration of Each Component 2-1. Photosensitive Drums

The photosensitive drums 1 are each formed by applying an organic photoconductive layer (OPC) to the outer peripheral surface of an aluminum cylinder. The photosensitive drum 1 is rotatably supported by flanges at both end portions in its longitudinal direction (rotational axis direction). A driving force is transmitted from a drive motor (not illustrated) to one of the end portions, whereby the photosensitive drum 1 is driven to rotate. In the present exemplary embodiment, the photosensitive drum 1 has a negative charging polarity.

In the present exemplary embodiment, the photosensitive drums 1Y, 1M, and 1C of the first, second, and third image forming units SY, SM, and SC for yellow, magenta, and cyan, respectively have an outer diameter of ϕ30 mm. The photosensitive drum 1K of the fourth image forming unit SK for black has an outer diameter of ϕ80 mm. In other words, only the photosensitive drum 1K for black is larger than the photosensitive drums 1Y, 1M, and 1C for the other colors.

2-2. Charging Rollers

The charging rollers 2 each are a contact charging member which makes contact with the surface of the corresponding photosensitive drum 1 to uniformly charge the circumferential surface of the photosensitive drum 1. The charging roller 2 is a conductive roller including a core (core material) around which an elastic layer is formed. The charging roller 2 is rotatably held by bearing members at both end portions in its longitudinal direction (rotational axis direction), and is biased toward the photosensitive drum 1 by a pressing spring serving as a biasing unit. As a result, the charging roller 2 is pressed against the surface of the photosensitive drum 1 by a predetermined pressing force, and is driven to rotate by the rotation of the photosensitive drum 1. A charging power supply 21 (see FIG. 4) serving as an application unit applies a charging bias (charging voltage) having a predetermined condition to the core of the charging roller 2. The circumferential surface of the rotating photosensitive drum 1 is thereby charged to a predetermined potential of a predetermined polarity (negative polarity in the present exemplary embodiment). In the present exemplary embodiment, the charging bias is an oscillation voltage obtained by superposing an alternating-current voltage (Vac) on a direct-current voltage (Vdc). More specifically, the oscillation voltage is obtained by superposing a sinusoidal alternating-current voltage (alternating-current component) having a frequency f of 1 kHz and a peak-to-peak voltage Vpp of 1.5 kV on a direct-current voltage (direct-current component) of −600 V. As a result, the circumferential surface of the photosensitive drum 1 is uniformly charged to −600 V (dark potential Vd).

2-3. Exposure Devices

The exposure devices 3 each are a laser scanner device which includes a laser light source and a polygonal mirror and is controlled on/off by a driving circuit according to an image signal. The exposure device 3 projects a laser beam according to the image signal of a color component in a document corresponding to the image forming unit S, upon the photosensitive drum 1 via the polygonal mirror.

2-4. Developing Devices

The developing devices 4 each use a two-component developer including nonmagnetic toner and a magnetic carrier as a developer. In the present exemplary embodiment, the toner has a negative charging characteristic. The developing device 4 includes a developing container storing the developer. The developing device 4 also includes a developing sleeve serving as a developer bearing member. The developing sleeve is arranged to be partly exposed from an opening of the developing container opposed to the photosensitive drum 1. The developing sleeve is arranged next to the surface of the photosensitive drum 1, and driven to rotate by a drive motor (not illustrated) serving as a drive unit. A developing power supply (not illustrated) serving as an application unit applies a predetermined developing bias (developing voltage) to the developing sleeve. Consequently, toner is supplied from the developer borne and conveyed to the position (developing portion) opposite to the photosensitive drum 1 by the developing sleeve, whereby the electrostatic latent image on the photosensitive drum 1 is developed as a toner image. In the present exemplary embodiment, the developing device 4 forms the toner image by a reversal phenomenon of causing toner having a polarity same as the charging polarity of the photosensitive drum 1 to attach to exposed portions of the photosensitive drum 1 where the absolute value of the potential is lowered after the uniform charging of the photosensitive drum 1. To improve releasability of the toner, an external additive is added to the toner.

2-5. Primary Transfer Rollers

The primary transfer rollers 5 each are a conductive roller including a core (core material) around which an elastic layer is formed. The core is a cylindrical member made of conductive metal and having a diameter of 8 mm. The elastic layer is a conductive foam member having a resistance of $1.0\times10^4$ to $5.0\times10^6\Omega$ and a thickness of 0.5 mm. The elastic layer covers the periphery of the core. The primary transfer roller 5 also has a weight of 300 g. In the present exemplary embodiment, the primary transfer rollers 5 of all the image forming units S have the same outer diameter.

The primary transfer roller 5 transfers the toner images from the photosensitive drum 1 onto the intermediate transfer belt 7 by an electrical action and a pressing force. For that purpose, the primary transfer roller 5 is supported by a pressing mechanism so as to be brought into contact with the photosensitive drums 1 from the back side of the intermediate transfer belt 7. In the present exemplary embodiment, the primary transfer roller 5 is pressed vertically upward by a pressing spring serving as a biasing unit at both end portions in its longitudinal direction (rotational axis direction).

Figure 13:
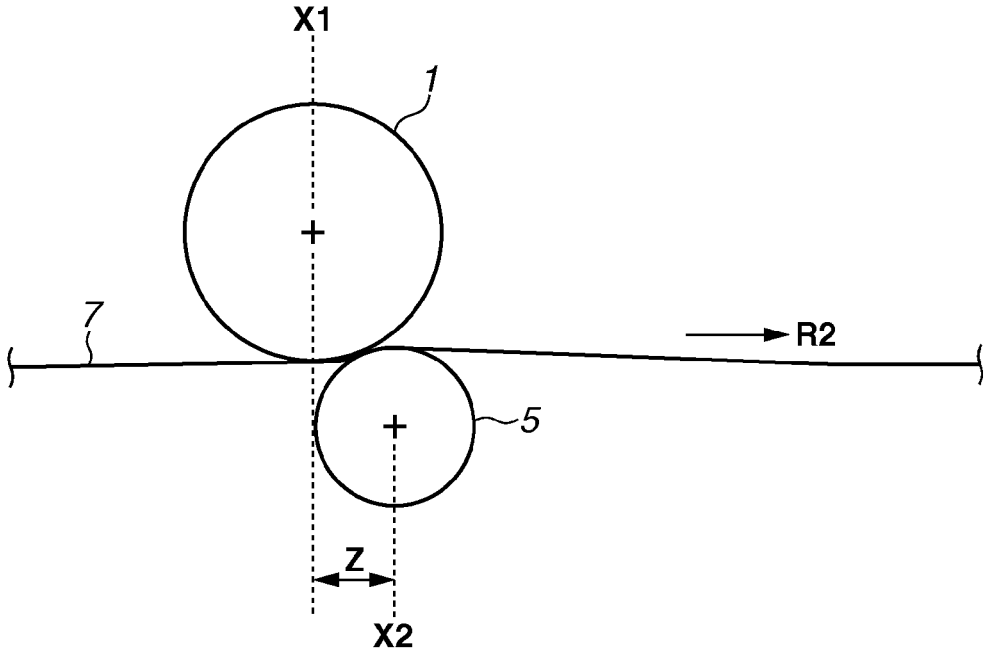
FIG. 13 is a schematic diagram illustrating a shift amount of a primary transfer roller.

The primary transfer roller 5 is shifted downstream in the conveyance direction of the intermediate transfer belt 7 with respect to the vertical direction passing through the rotation center of the photosensitive drum 1. In the present exemplary embodiment, the primary transfer rollers 5Y, 5M, and 5C of the first, second, and third image forming units SY, SM, and SC are shifted by an amount of 2.5 mm. The primary transfer roller 5K of the fourth image forming unit SK is shifted by an amount of 4.5 mm. As illustrated in FIG. 13, suppose that the straight line that passes through the rotation center of the photosensitive drum 1 and is orthogonal to the intermediate transfer belt 7 is X1. Suppose also that the straight line that passes through the rotation center of the primary transfer roller 5 and is parallel to the straight line X1 is X2. In such a case, in the present exemplary embodiment, the shift amount Z of the primary transfer roller 5 with respect to the photosensitive drum 1 can be represented by the shift amount of the straight line X2 with respect to the straight line X1.

The pressing force of the primary transfer roller 5 can be measured by using a pressure measuring jig. For example, a pseudo metal counter roller that has the same diameter as that of the photosensitive drum 1 and is split into five parts in the rotational axis direction is prepared. The pressing force of the primary transfer roller 5 is then measured by detecting pressure acting on the metal counter roller by using a load cell. Such a measurement system may be provided inside the main body of the image forming apparatus 100. This enables measurement of the pressure actually acting on the photosensitive drum 1 from the primary transfer roller 5. Using the five-way split metal counter roller also enables measurement of pressure distribution in the longitudinal direction of the primary transfer roller 5. In the present exemplary embodiment, the primary transfer rollers 5Y, 5M, and 5C of the first, second, and third image forming units SY, SM, and SC have a total pressing force of 600 to 800 gf. On the other hand, the primary transfer roller 5K of the fourth image forming apparatus SK has a pressing force of 1300 to 1500 gf. Adjusting the shift amounts and pressures according to the diameters of the photosensitive drums 1 pressed by the primary transfer rollers 5 provides favorable transferability.

In the present exemplary embodiment, the distance between the primary transfer portions T1 of the adjoining image forming units S is 120 mm in the conveyance direction of the intermediate transfer belt 7.

In the present exemplary embodiment, the image forming apparatus 100 is capable of performing a full color mode (first image forming mode) and a black monochrome mode (second image forming mode or monochrome image forming mode) as a plurality of image forming modes in which different numbers of image forming units S are used to form a toner image(s). In the full color mode, the first, second, third, and fourth image forming units SY, SM, SC, and SK form toner images, whereby a full color image can be formed. In the black monochrome mode, only the fourth image forming unit SK forms a toner image as the predetermined image forming unit among the first, second, third, and fourth image forming units SY, SM, SC, and SK, whereby a black image can be formed. The image forming apparatus 100 includes a belt contact/separation mechanism 170 (see FIG. 4) which can keep the photosensitive drums 1Y, 1M, and 1C of the image forming units SY, SM, and SC, which are not used in the black monochrome mode, out of contact with the intermediate transfer belt 7.

Figure 2:
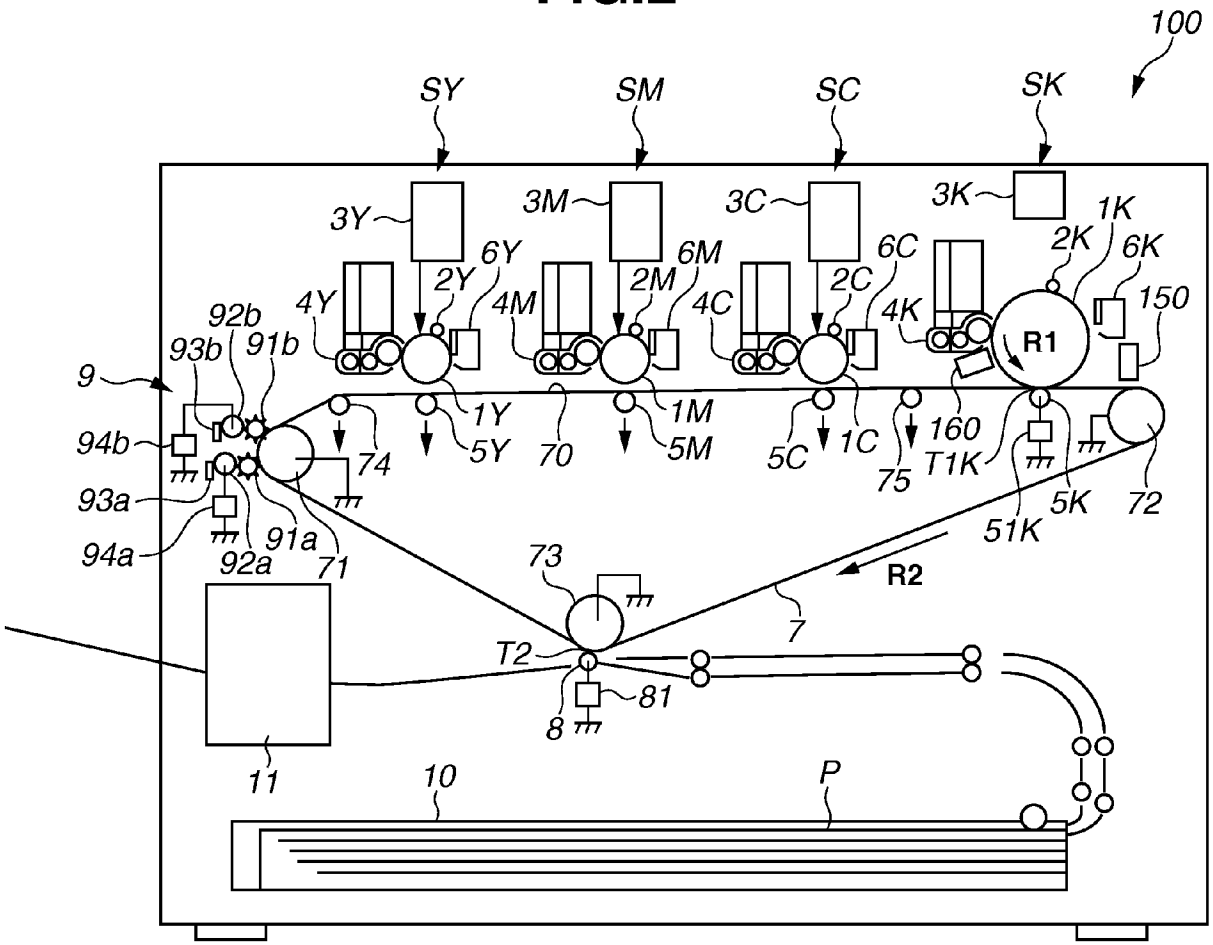
FIG. 2 is a schematic sectional view of the image forming apparatus (in a black monochrome mode).

In the present exemplary embodiment, the primary transfer plane 70 moves when the push-up rollers 74 and 75 and the primary transfer rollers 5Y, 5M, and 5C of the first, second, and third image forming units SY, SM, and SC move vertically as illustrated in FIG. 2. In the full color mode, the primary transfer plane 70 is formed by the push-up rollers 74 and 75 and the tension roller 72. On the other hand, in the black monochrome mode, the primary transfer plane 70 is formed by the push-up roller 75 on the downstream side in the conveyance direction of the intermediate transfer belt 7 and the tension roller 72. Consequently, in the full color mode, the photosensitive drums 1Y, 1M, 1C, and 1K of the first, second, third, and fourth image forming units SY, SM, SC, and SK are brought into contact with the intermediate transfer belt 7. In the black monochrome mode, the photosensitive drums 1Y, 1M, and 1C of the first, second, and third image forming units SY, SM, and SC are separated from the intermediate transfer belt 7. In such a manner, the image forming apparatus 100 is configured to be able to selectively switch between the black monochrome mode and the full color mode. The belt contact/separation mechanism 170 (see FIG. 4) includes support members for the push-up rollers 74 and 75 and the primary transfer rollers 5Y, 5M, and 5C of the first, second, and third image forming units SY, SM, and SC, and a switching unit for moving such rollers via the support members. In the present exemplary embodiment, a solenoid is used as the switching unit. The switching unit moves the rollers 74, 75, 5Y, 5M, and 5C vertically, i.e., selectively between a first position where the intermediate transfer belt 7 is located closer to the photosensitive drums 1 and a second position where the intermediate transfer belt 7 is located farther from the photosensitive drums 1. In the present exemplary embodiment, the photosensitive drums 1Y, 1M, and 1C of the first, second, and third image forming units SY, SM, and SC, which are not used in the black monochrome mode, are separable from the intermediate transfer belt 7. This increases the life of the photosensitive drums 1Y, 1M, and 1C. Further, the photosensitive drum 1K of the fourth image forming unit SK for black, of which the use frequency is often high, is configured to have a large diameter. This increases the life of the photosensitive drum 1K. The image forming unit using a photosensitive drum of large diameter need not necessarily be the image forming unit 1K for black or be the most downstream one in the conveyance direction of the intermediate transfer belt 7. Further, a photosensitive drum of large diameter is not necessarily used for only one image forming unit such as the image forming unit 1K for black. A plurality of image forming units may be configured to use a photosensitive drum having an outer diameter larger than that of the other image forming unit(s) (such a plurality of image forming units may use photosensitive drums of the same or different outer diameters). Alternatively, the photosensitive drums 1 of all the image forming units S may have the same diameter if desired.

2-6. Intermediate Transfer Belt

Figure 14:
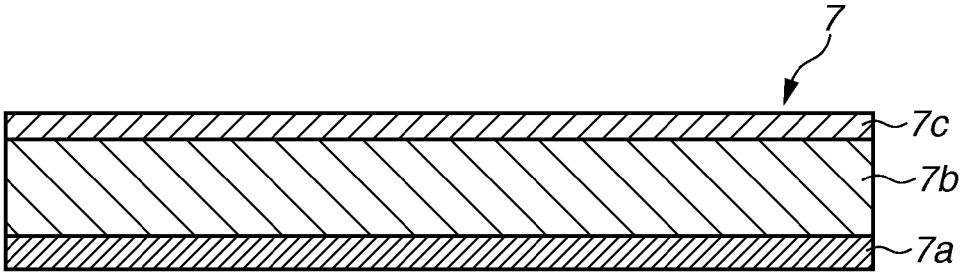
FIG. 14 is a schematic sectional view illustrating a layer configuration of the intermediate transfer belt.

In the present exemplary embodiment, a belt having a plurality of layers and also having an elastic layer is used as the intermediate transfer belt 7 (hereinafter also referred to as an "elastic intermediate transfer belt"). FIG. 14 is a schematic sectional view illustrating an example of a layer configuration of the elastic intermediate transfer belt 7. In the present exemplary embodiment, the elastic intermediate transfer belt 7 has a three-layer structure including a base layer (resin layer) 7*a*, an elastic layer 7*b*, and a surface layer 7*c*. To maintain image properties, the three-layer elastic intermediate transfer belt 7 according to the present exemplary embodiment has a surface resistivity of $10^{12}\Omega/\square$ and a volume resistivity of $10^{9}$ Ω·cm. The resistivities were measured by using a high resistivity meter Hiresta UPM, CP-HT450, UR probe manufactured by Mitsubishi Chemical Corporation, with a measurement condition including an applied voltage of 1000 V and an application time of 10 seconds. As for the thicknesses of the layers of the elastic intermediate transfer belt 7, it is desirable that the base layer 7*a* has a thickness of approximately 50 to 100 μm, the elastic layer 7*b* has a thickness of approximately 200 to 300 μm, and the surface layer 7*c* has a thickness of approximately 2 to 20 μm. In the present exemplary embodiment, the base layer 7*a* is 85 μm thick, the elastic layer 7*b* is 260 μm thick, and the surface layer 7*c* is 2 μm thick. Further, it is desirable that the three-layer elastic intermediate transfer belt 7 have an International Rubber Hardness Degrees (IRHD) hardness of approximately 40 to 90 degrees. In the present exemplary embodiment, the elastic intermediate transfer belt 7 has an IRHD hardness of 73±3 degrees.

The base layer 7*a* and the elastic layer 7*b* can be made of any material as long as the foregoing characteristics are satisfied. Typical examples include the following. Examples of resin materials that can be used to constitute the base layer (resin layer) 7*a* include polycarbonates, fluorine-BASED resins (ethylene tetrafluoroethylene (ETFE) and polyvinylidene difluoride (PVDF)), polyamide resins, and polyimide resins having a Young's modulus (compliant with Japanese Industrial Standards (JIS) K 7127) of $5.0\times10^{2}$ to $5.0\times10^{3}$ MPa. Examples of elastic materials (elastic rubbers and elastomers) that can be used to constitute the elastic layer 7*b* include butyl rubber, fluorine-based rubber, chloroprene rubber (CR), ethylene propylene diene monomer (EPDM), and urethane rubber having a Young's modulus of 0.1 to $1.0\times10^{2}$ MPa. The surface layer 7*c* is not limited to a particular material. It is desirable that the surface layer 7*c* be made of a material that reduces the adhesion of toner to the surface of the intermediate transfer belt 7 for improved secondary transferability. Examples include resin materials such as fluorine resins and fluorine compounds having a Young's modulus of $1.0\times10^{2}$ to $5.0\times10^{3}$ MPa, urethane type resins in which fluorine type resin particles are dispersed, and elastic materials. None of the base layer 7*a*, the elastic layer 7*b*, and the surface layer 7*c* is limited to the foregoing materials. In the present exemplary embodiment, as described above, the intermediate transfer member includes at least a plurality of layers, and the layer on the side of the surface for bearing a toner image has a hardness lower than that of the bottommost layer on the side of the surface for not bearing a toner image.

In the present exemplary embodiment, the elastic intermediate transfer belt described above is used as the intermediate transfer belt 7. Alternatively, a single-layer belt such as a resin belt may be used.

In the present exemplary embodiment, the photosensitive drums 1 and the intermediate transfer belt 7 are driven so that a difference in speed between the surfaces of the photosensitive drums 1 and the surface of the intermediate transfer belt 7 falls within the range of 0% to 0.5%.

2-7. Secondary Transfer Roller

The secondary transfer roller 8 is a conductive roller including a core (core material) around which an elastic layer of ion conductive foam rubber (nitrile-butadiene rubber (NBR)) is formed. The secondary transfer roller 8 has an outer diameter of 24 mm and a roller surface roughness Rz of 6.0 to 12.0 μm. The secondary transfer roller 8 also has a resistance of $1.0\times10^{5}$ to $1.0\times10^{8}\Omega$ in measurement at normal temperature and normal humidity (N/N) (23° C., 50% in relative humidity (RH)) with an application of 2 kV.

In the present exemplary embodiment, the image forming apparatus 100 includes a secondary transfer roller contact/separation mechanism 180 (see FIG. 4) for bringing the secondary transfer roller 8 into contact with the intermediate transfer belt 7 or separating the secondary transfer roller 8 from the intermediate transfer belt 7. The secondary transfer roller 8 is thus configured to be able to selectively switch between an operating state and a non-operating state. In the operating state, the secondary transfer roller 8 is brought into contact with the intermediate transfer belt 7 and rotates with the rotation of the intermediate transfer belt 7. In the non-operating state, the secondary transfer roller 8 is separated from the intermediate transfer belt 7. The secondary transfer roller contact/separation mechanism 180 includes a support member for the secondary transfer roller 8 and a switching unit for moving the secondary transfer roller 8 via the support member. In the present exemplary embodiment, a solenoid is used as the switching unit. The switching unit moves the secondary transfer roller 8 vertically, i.e., selectively between a first position where the secondary transfer roller 8 is brought into contact with the intermediate transfer belt 7 and a second position where the secondary transfer roller 8 is separated from the intermediate transfer belt 7. In the present exemplary embodiment, the secondary transfer roller 8 is separated from the intermediate transfer belt 7 when a patch passes through the secondary transfer portion T2. Further, in the present exemplary embodiment, in a case where the secondary transfer roller 8 has been in contact with the intermediate transfer belt 7 for two seconds or more during a period (e.g., a sheet-to-sheet interval) other than a period (sheet passing period) during which a transfer material P passes through the secondary transfer portion T2, the secondary transfer roller 8 immediately gets separated from the intermediate transfer belt 7. This prevents the backside of the transfer material P from being stained by toner adhering to the secondary transfer roller 8.

2-8. Belt Cleaning Device (Electrostatic Fur Cleaning)

Figure 3:
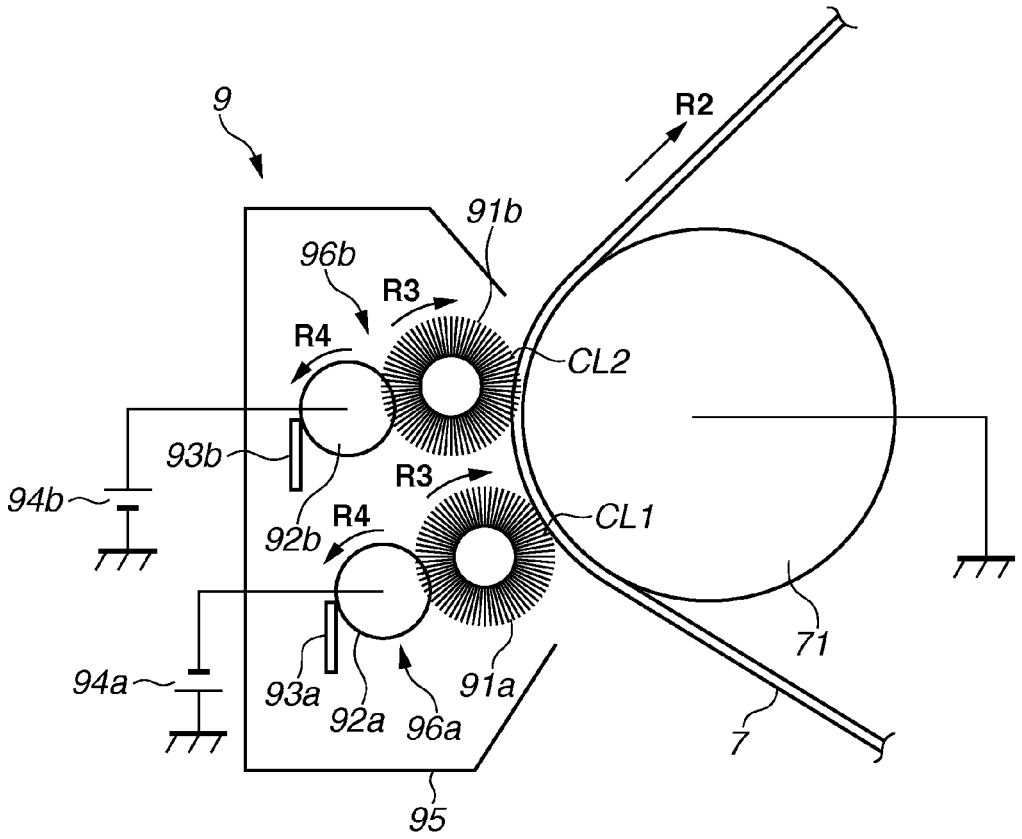
FIG. 3 is a schematic sectional view of a belt cleaning device.

In the present exemplary embodiment, the belt cleaning device 9 using an electrostatic cleaning method for removing toner in an electrostatic manner is used as the intermediate transfer member cleaning unit. FIG. 3 is a schematic sectional view of the belt cleaning device 9 according to the present exemplary embodiment. The belt cleaning device 9 is arranged upstream of the primary transfer portions T1 (more specifically, the most upstream primary transfer portion T1Y) and downstream of the secondary transfer portion T2 in the conveyance direction of the intermediate transfer belt 7.

The belt cleaning device 9 includes an upstream fur brush 91*a* and a downstream fur brush 91*b* in a housing 95. The upstream fur brush 91*a* serves as a first collection member which is arranged on an upstream side in the conveyance direction of the intermediate transfer belt 7. The downstream fur brush 91*b* serves as a second collection member which is arranged on a downstream side in the conveyance direction of the intermediate transfer belt 7. The upstream and downstream fur brushes 91*a* and 91*b* make contact with the intermediate transfer belt 7 in respective positions opposed to the driving roller 71 via the intermediate transfer belt 7, and form first and second electrostatic cleaning portions CL1 and CL2 for collecting toner from the intermediate transfer belt 7. The belt cleaning device 9 further includes an upstream bias roller 92*a* and a downstream bias roller 92*b* in the housing 95. The upstream bias roller 92*a* serves as a first voltage application member which makes contact with the upstream fur brush 91*a*. The downstream bias roller 92*b* serves as a second voltage application member which makes contact with the downstream fur brush 91*b*. The belt cleaning device 9 further includes an upstream blade 93*a* and a downstream blade 93*b* in the housing 95. The upstream blade 93*a* serves as a first removal member which makes contact with the upstream bias roller 92*a*. The downstream blade 93*b* serves as a second removal member which makes contact with the downstream bias roller 92*b*.

The upstream and downstream fur brushes (cleaning brushes) 91*a* and 91*b* are electrically conductive fur brushes. In the present exemplary embodiment, the upstream and downstream fur brushes 91*a* and 91*b* have a diameter of 32 mm. The upstream and downstream bias rollers 92*a* and 92*b* are formed by metal rollers made of aluminum. In the present exemplary embodiment, the upstream and downstream bias rollers 92*a* and 92*b* have a diameter of 20 mm. The upstream and downstream blades 93*a* and 93*b* are formed by plate-like members made of urethane rubber.

The upstream and downstream fur brushes 91*a* and 91*b* are arranged to make sliding contact with the intermediate transfer belt 7 with an intrusion amount of approximately 1.0 mm with respect to the intermediate transfer belt 7. The upstream and downstream fur brushes 91*a* and 91*b* are driven to rotate in a direction indicated by an arrow R3 in FIG. 3 at a speed (circumferential speed) of 50 mm/sec by a drive motor (not illustrated) serving as a drive unit. The moving direction indicated by the arrow R3 is opposite to the moving direction of the intermediate transfer belt 7 in the first and second electrostatic cleaning portions CL1 and CL2. The upstream and downstream bias rollers 92*a* and 92*b* are arranged with an intrusion amount of approximately 1.0 mm with respect to the upstream and downstream fur brushes 91*a* and 91*b*. The upstream and downstream bias rollers 92*a* and 92*b* are driven to rotate in a direction indicated by an arrow R4 in FIG. 3 at a speed (circumferential speed) equivalent to that of the upstream and downstream fur brushes 91*a* and 91*b* by a drive motor (not illustrated) serving as a drive unit. The moving direction indicated by the arrow R4 is opposite to the moving direction of the upstream and downstream fur brushes 91*a* and 91*b* in the contact portions with the upstream and downstream fur brushes 91*a* and 91*b*.

A first cleaning power supply 94*a* serving as an application unit applies a direct-current voltage of negative polarity to the upstream bias roller 92*a* as a cleaning bias (cleaning voltage). A second cleaning power supply 94*b* serving as an application unit applies a direct-current voltage of positive polarity to the downstream bias roller 92*b* as a cleaning bias.

3. Patch Sensors

The image forming apparatus 100 according to the present exemplary embodiment includes an on-belt patch sensor 150 and an on-drum patch sensor 160 as detection units for detecting a patch. The patch refers to an adjustment toner image used in an adjustment operation of the image forming apparatus 100.

4. Control Configuration

Figure 4:
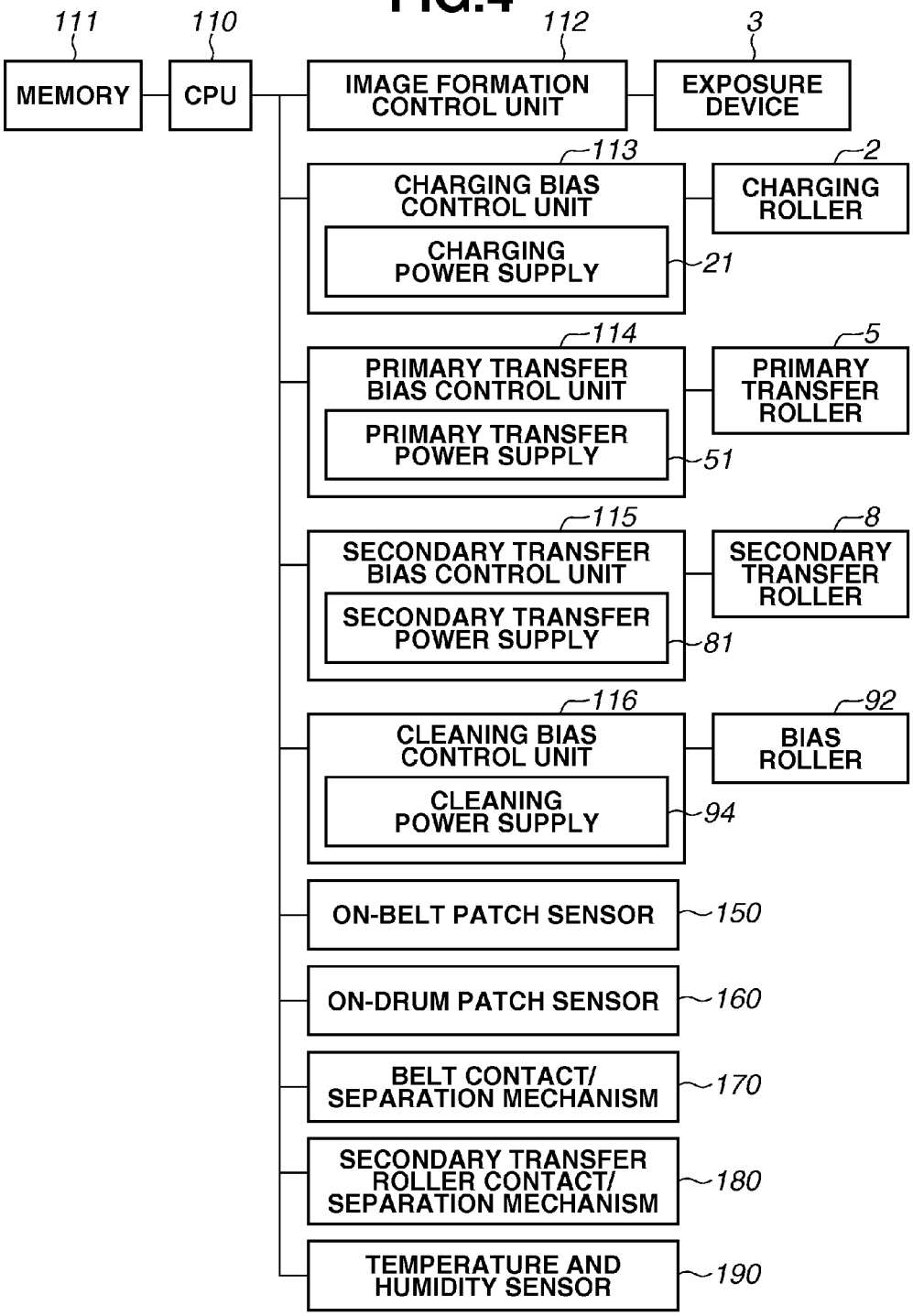
FIG. 4 is a control block diagram of essential parts of the image forming apparatus.

FIG. 4 illustrates a schematic control configuration of essential parts of the image forming apparatus 100 according to the present exemplary embodiment. The image forming apparatus 100 includes a central processing unit (CPU) 110 serving as a control unit for controlling the image forming apparatus 100 in a centralized manner, and a memory 111 serving as a storage unit. The memory 111 includes a read-only memory (ROM) and a random access memory (RAM). The RAM stores detection results of sensors and calculation results. The ROM stores a control program and a data table determined in advance. As far as the present exemplary embodiment is concerned, the CPU 110 controls an image formation control unit 112, a charging bias control unit 113, a primary transfer bias control unit 114, a secondary transfer bias control unit 115, and a cleaning bias control unit 116. The CPU 110 also controls the on-belt patch sensor 150, the on-drum patch sensor 160, the belt contact/separation mechanism 170, the secondary transfer roller contact/separation mechanism 180, and a temperature and humidity sensor 190.

The image formation control unit 112 controls exposure timing of the exposure devices 3. The charging bias control unit 113 can output a constant voltage-controlled voltage from the charging power supply 21 to the charging rollers 2. The primary transfer bias control unit 115 can output a constant current-controlled voltage and a constant voltage-controlled voltage from the primary transfer power supplies 51 to the primary transfer rollers 5. The secondary transfer bias control unit 115 operates in a similar manner to the primary transfer bias control unit 114.

5. Change in Volume Resistivity of Intermediate Transfer Belt

Next, a change in the volume resistivity of the intermediate transfer belt 7 used in the present exemplary embodiment will be described.

The rubber layer (elastic layer) 7*b* of the intermediate transfer belt 7 used in the present exemplary embodiment uses ion conductive CR. In other words, the intermediate transfer member according to the present exemplary embodiment contains an ion conductive agent. Ion conductive rubber materials are known to develop polarization and cause a gradual increase in the volume resistivity if a voltage continues to be applied thereto over a long period of time. In the present exemplary embodiment, the volume resistivity of the entire intermediate transfer belt 7 has also been confirmed to increase in a long period of use because of the increase in the volume resistivity of the rubber layer 7*b*.

Portions for applying a voltage to the intermediate transfer belt 7 of the image forming apparatus 100 according to the present exemplary embodiment include the primary transfer portions T1, the secondary transfer portion T2, and the electrostatic cleaning portions CL1 and CL2. In the primary transfer portions T1, a primary transfer current is applied to the intermediate transfer belt 7 from the photosensitive drums 1, whereby toner images are primarily transferred onto the intermediate transfer belt 7. In the secondary transfer portion T2, a current having an opposite polarity to that at the time of the primary transfer is applied to the toner images on the intermediate transfer belt 7, whereby the toner images are transferred onto the transfer material P. In the electrostatic cleaning portions CL1 and CL2, a current of the same polarity as and a current of opposite polarity to that of the primary transfer portions T1 are applied in succession, the currents being intended to collect toner images remaining on the intermediate transfer belt 7 in electrostatic cleaning members 96*a* and 96*b* as residual transfer toner. In the case of a full color image, the four primary transfer portions T1 and one of the electrostatic cleaning portions CL1 and CL2 have the polarity of increasing the volume resistivity of the intermediate transfer belt 7. The secondary transfer portion T2 and the other of the electrostatic cleaning portions CL1 and CL2 have the polarity of suppressing an increase in the volume resistivity of the intermediate transfer belt 7. For a full color image, the voltage application in the primary transfer portions T1 is performed four times in succession. Thus, the increase in the volume resistivity of the intermediate transfer belt 7 becomes the largest.

Figure 5:
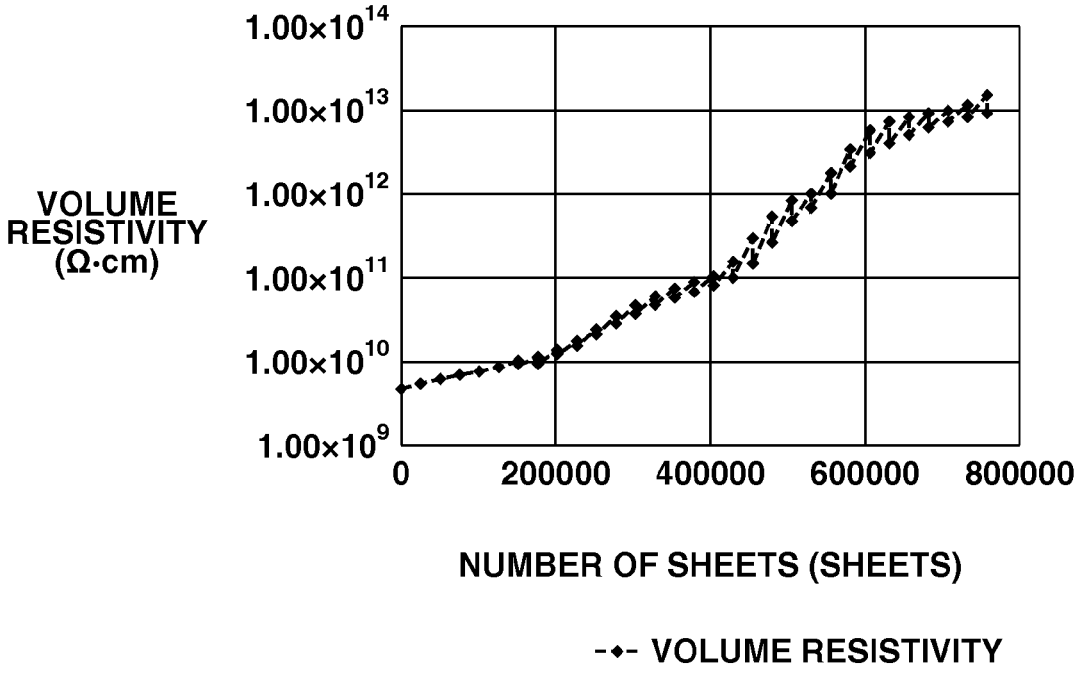
FIG. 5 is a graph illustrating an example of a relationship between the number of images formed and a volume resistivity of an intermediate transfer belt.

FIG. 5 illustrates a relationship between the volume resistivity of the intermediate transfer belt 7 and the number of full color images formed according to the present exemplary embodiment. The volume resistivity was measured at measurement timing which is before and after a day's use. The volume resistivity was measured by using a high resistivity meter Hiresta UPM, CP-HT450, UR probe manufactured by Mitsubishi Chemical Corporation, with a measurement condition including an applied voltage of 1000 V and an application time of 10 seconds. The initial volume resistivity was $5.0\times10^{9}$ Ω·cm. The volume resistivity is shown to increase gradually as the number of formed images increases. The volume resistivity increases with repeated ups and downs, which indicates daily variations. The volume resistivity is low before a day's use, and high after the day's use. The volume resistivity falls during the unused period before the next day's use, but is still higher than that on the previous day. This indicates that the distribution of the conductive agent polarized by the previous day's use restores during the unused period, but not completely, and that the volume resistivity is on the increase.

The intermediate transfer member used in the present exemplary embodiment exceeds a volume resistivity of $1.0\times10^{11}$ Ω·cm due to cumulative energization. The intermediate transfer member used in the present exemplary embodiment was found to change in volume resistivity by one digit or more if energized so that a value obtained by multiplying the amount of energization per unit area of the intermediate transfer member by the cumulative time is 30.0 $A/m^2$ or more. Such an intermediate transfer member can be said to be an intermediate transfer member of which resistance changes relatively largely due to image formation.

To examine primary transfer efficiencies at different volume resistivities, the intermediate transfer belt 7 was repeatedly used up to a volume resistivity of $1\times10^{12}$ Ω·cm, and the transfer efficiency and retransfer efficiency in primary transfer of a monochromatic solid image at a volume resistivity of $1.0\times10^{10}$ Ω·cm and $1\times10^{12}$ Ω·cm were determined. The transfer efficiency refers to a transfer rate in the primary transfer portion T1 with the toner developed on the photosensitive drum 1 as 100%. The transfer efficiency is determined by dividing the amount of post-transfer toner by the amount of pre-transfer toner. The retransfer efficiency is determined by dividing the amount of retransferred toner on the photosensitive drum 1 by the amount of toner on the intermediate transfer belt 7 before the photosensitive drum 1 passes. The environment was 23° C. and 50% in RH. The density of the solid image was 0.5 $mg/cm^2$. The electric resistance of the primary transfer roller 5 used was $2.0\times10^{6}$Ω.

Figure 6:
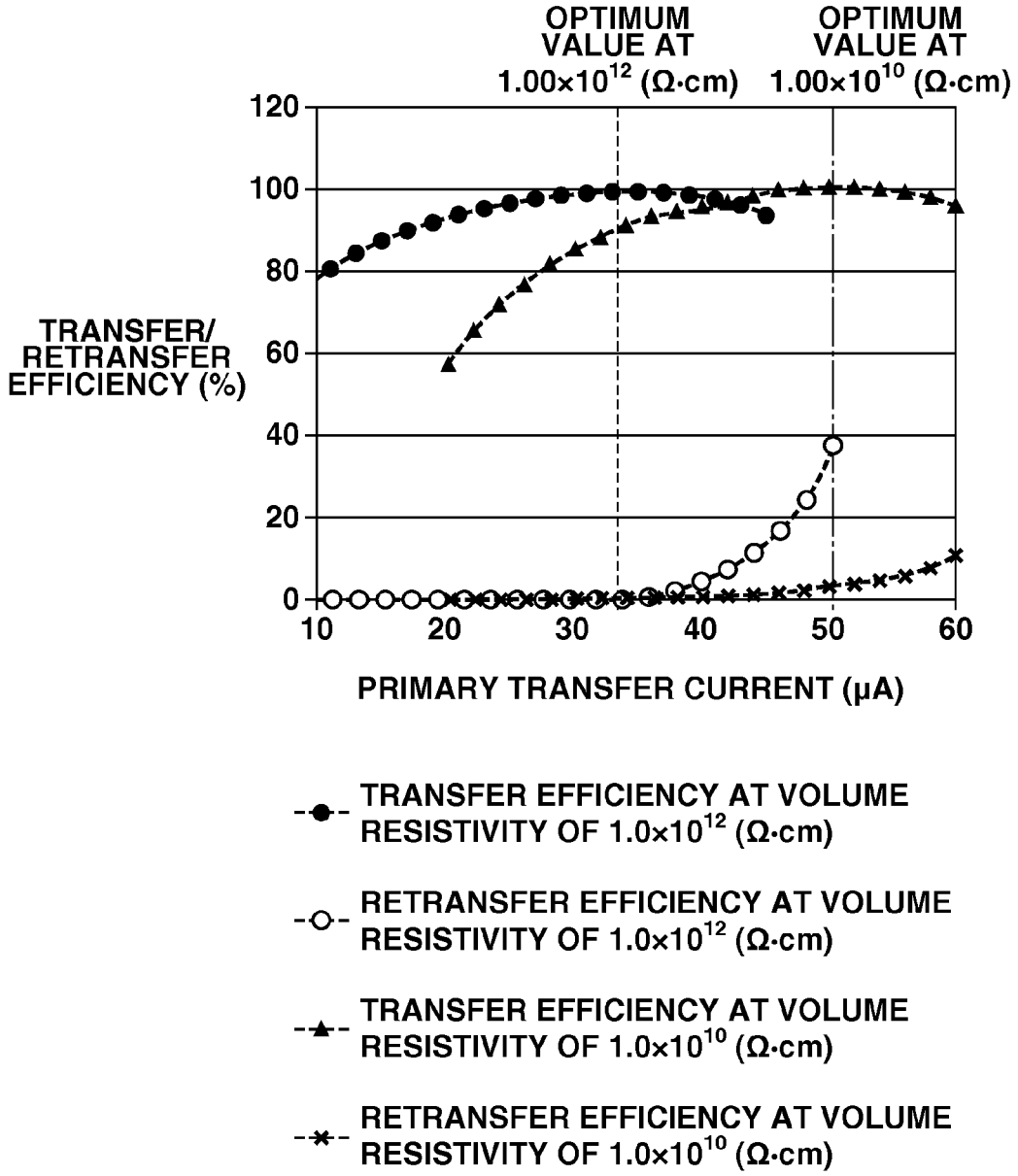
FIG. 6 is a graph illustrating transfer efficiency and retransfer efficiency.

FIG. 6 illustrates the primary transfer efficiency of the intermediate transfer belt 7 at a volume resistivity of $1.0\times10^{10}$ Ω·cm and $1\times10^{12}$ Ω·cm. As illustrated in FIG. 6, an optimum transfer current (required current) for both the transfer efficiency and the retransfer efficiency decreases as the volume resistivity of the intermediate transfer belt 7 increases. The optimum transfer current refers to a current value that is well balanced so that the transfer efficiency is high and the retransfer efficiency is low. For example, the graph illustrated in FIG. 6 shows that if the intermediate transfer belt 7 has a volume resistivity of $1.0\times10^{10}$ Ω·cm, the optimum transfer current is 50 μA. The graph illustrated in FIG. 6 also shows that if the intermediate transfer belt 7 has a volume resistivity of $1.0\times10^{12}$ Ω·cm, the optimum transfer current is 33 μA.

Figure 7:
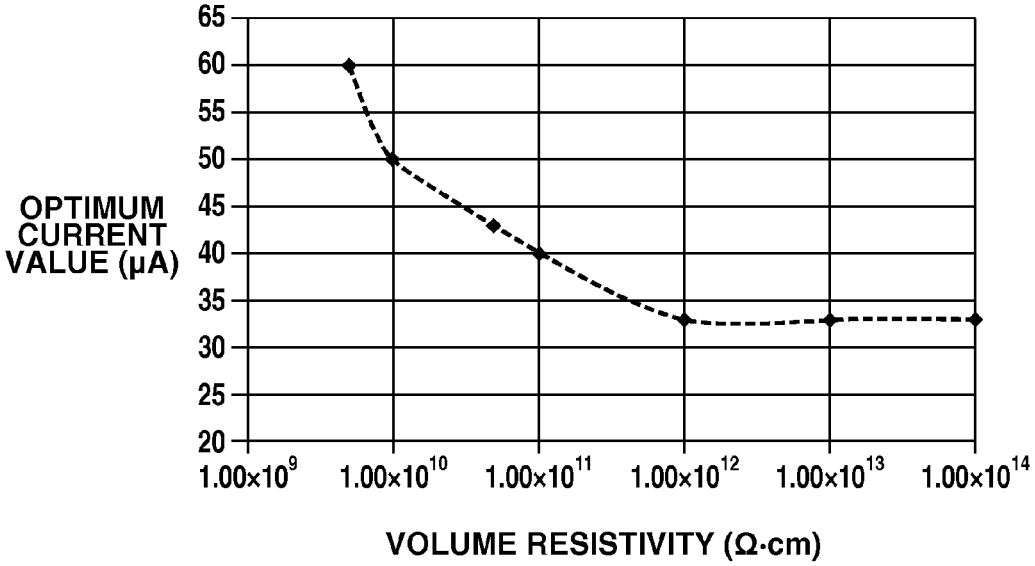
FIG. 7 is a graph illustrating an example of a relationship between the volume resistivity of the intermediate transfer belt and an optimum current value of a transfer current.

FIG. 7 illustrates plots of the optimum transfer current obtained by similarly examining the transfer and retransfer efficiencies of the intermediate transfer belt 7 at other volume resistivities. FIG. 7 shows that the lower the volume resistivity, the higher the optimum current value, and that the higher the volume resistivity, the lower the optimum current value. A possible reason for this is as follows: If the resistance of the primary transfer portion T1 is low, areas with toner and without toner have a difference in resistance which corresponds to the toner in the primary transfer. Due to the difference in resistance, a current is less likely to flow through the area with toner, and more likely to flow through the area without toner. Consequently, the transfer field in the area where there is actually toner becomes relatively low, and the required current becomes high. In contrast, if the resistance of the primary transfer portion T1 is high, the transfer field is uniform regardless of the presence or absence of toner, and the required current becomes low. FIG. 7 shows that the optimum current value changes in the range of the volume resistivity of the intermediate transfer belt 7 from $5\times10^{9}$ Ω·cm to $1\times10^{12}$ Ω·cm, and remains almost the same in the range of the volume resistivity of the intermediate transfer belt 7 from $1\times10^{12}$ Ω·cm to $1\times10^{14}$ Ω·cm. The possible reason is that, with the volume resistivity of the intermediate transfer belt 7 less than $1\times10^{12}$ Ω·cm, a current difference occurs between the areas with toner and without toner, and with the volume resistivity of $1\times10^{12}$ Ω·cm or higher, such a current difference disappears.

Suppose, for example, that the optimum current according to the initial volume resistivity of the intermediate transfer belt 7 continues to be used with an increase in the amount of use of the intermediate transfer belt 7. In such a case, the transfer efficiency decreases and the retransfer efficiency increases with an increase in the amount of use. This not only causes a loss of the transfer efficiency but also causes a void. More specifically, if there are toner layers arranged with a gap therebetween like a halftone image, an excessive current causes a discharge in the gap. This reverses the triboelectricity (electrification charge) of the toner, and the toner fails to be primarily transferred and returns to the photosensitive drum 1. Such a phenomenon is referred to as a void. In addition, passing an excessive current through the primary transfer portion T1 accelerates the degree of resistance increase of the members of which a resistance increase can occur due to energization, such as the intermediate transfer belt 7 and the primary transfer roller 5. If the members such as the intermediate transfer belt 7 and the primary transfer roller 5 reach a certain resistance value (or the amount of use with which the members are predicted to usually reach the certain resistance value), the members are typically replaced, while being considered to have expired their parts life. The acceleration of the degree of resistance increase shortens the parts life. Adjusting the primary transfer current to an optimum current value according to the electric resistance of the primary transfer portion T1 can keep the transfer efficiency high and the retransfer efficiency low regardless of an increase in the amount of use of the intermediate transfer belt 7, and can also suppress a resistance increase due to unnecessary energization.

However, if the primary transfer current is uniformly set to the optimum current according to the electric resistance of the primary transfer portion T1, the following problem can occur.

A high primary transfer current needs to be set in a region where the volume resistivity is low, whereas the high primary transfer current may cause a memory in the photosensitive drum 1. If an excessive primary transfer current is applied to the photosensitive drum 1, a memory occurs in the photosensitive drum 1, making it difficult for the charging roller 2 serving as a charging unit to charge the photosensitive drum 1 to a desired potential. The area in the photosensitive drum 1 which undergoes the excessive transfer bias may only be able to be charged to a value lower than a desired charging potential. If such a photosensitive drum 1 is exposed by the exposure device 3, the exposure potential may become uneven, resulting in the occurrence of uneven development. In the present exemplary embodiment, if the initial volume resistivity of the intermediate transfer belt 7 is $5\times10^{9}$ Ω·cm, the optimum current value determined based on the foregoing transfer and retransfer efficiencies is 60 μA. It was found that the passing of a current of 60 μA or higher caused an excessive primary transfer current, resulting in a memory in the photosensitive drum 1.

The graph illustrated in FIG. 7 indicates that the optimum current value varies little in the region where the volume resistivity is high, more specifically, the volume resistivity is $1\times10^{12}$ Ω·cm or higher, as described above. Despite this, if the primary transfer current is set in a substantially linear manner according to the volume resistivity as is the case with $1\times10^{12}$ Ω·cm or lower, the primary transfer current value is reduced more than necessary. If the resulting primary transfer current is 25 μA or lower, a transfer defect image occurs due to an insufficient transfer current.

Thus, in the present exemplary embodiment, if the volume resistivity is $1\times10^{10}$ Ω·cm or lower, the primary transfer current value is controlled to be constant. If the volume resistivity is higher than $1\times10^{10}$ Ω·cm and lower than $1\times10^{12}$ Ω·cm, the primary transfer current is variably controlled. If the volume resistivity is $1\times10^{12}$ Ω·cm or higher, the primary transfer current value is controlled to be constant. Such control can provide favorable images. The volume resistivity of $1\times10^{10}$ Ω·cm corresponds to a threshold value Vc1 to be described below. The volume resistivity of $1\times10^{12}$ Ω·cm corresponds to a threshold value Vc2 to be described below. In actual control, as will be described in detail below, a transfer contrast voltage value is regarded as the electric resistance of the primary transfer portion T1. According to this transfer contrast voltage value, the regions where the primary transfer current value is to be variably controlled and where the primary transfer current value is to be controlled to be constant are determined.

6. Charge Amount of Intermediate Transfer Belt During Image Formation

Next, a change in the charge amount of the intermediate transfer belt 7 used in the present exemplary embodiment during image formation will be described.

As described above, in the image forming apparatus 100 according to the present exemplary embodiment, primary transfer currents are applied in the primary transfer portions T1 to transfer toner images onto the intermediate transfer belt 7. In the secondary transfer portion T2, a current of opposite polarity to that of the primary transfer portions T1 is applied to the toner images on the intermediate transfer belt 7, whereby the toner images are transferred onto the transfer material P. Toner images remaining on the intermediate transfer belt 7 are conveyed as transfer residual toner to the electrostatic cleaning portions CL1 and CL2, where a current of the same polarity as and a current of opposite polarity to that of the primary transfer portions T1 are successively applied to the transfer residual toner. In the case of a full color image, the electric current application in the primary transfer portions T1 is performed four times in succession.

The charge amount of the intermediate transfer belt 7 is associated with the amounts of currents applied in the four primary transfer portions T1, the secondary transfer portion T2, and the electrostatic cleaning portions CL1 and CL2, and the amount of charge eliminated by the grounded stretching rollers for the intermediate transfer belt 7. Moreover, the higher the process speed is and the smaller the distance between the primary transfer portions T1 of the adjoining image forming units S in the conveyance direction of the intermediate transfer belt 7 is, the greater the charge amount of the intermediate transfer belt 7 becomes as continuous image formation continues. The reason is that the intermediate transfer belt 7 charged in a preceding step (for example, in the primary transfer portion T1Y of the first image forming unit SY) proceeds to the next step (for example, the primary transfer portion T1C of the second image forming unit SC) without being electrically discharged, whereby the charge amounts are superposed. Further, the higher the volume resistivity of the intermediate transfer belt 7, the greater the charge amount of the intermediate transfer belt 7 during image formation.

As the charge amount of the intermediate transfer belt 7 increases, the voltages required to be applied in the primary transfer portions T1 increase by as much as the charge held by the intermediate transfer belt 7. Therefore, it is desirable that the voltages to be applied in the primary transfer portions T1 be adjusted to an optimum voltage value according to the charge amount of the intermediate transfer belt 7.

7. Voltage-Current Characteristic in Primary Transfer Portions

A voltage-current characteristic in the primary transfer portions T1 according to the present exemplary embodiment will be described. In the following description, the first, second, third, and fourth image forming units SY, SM, SC, and SK may be referred to as "Y station," "M station," "C station," and "K station," respectively.

Figure 8:
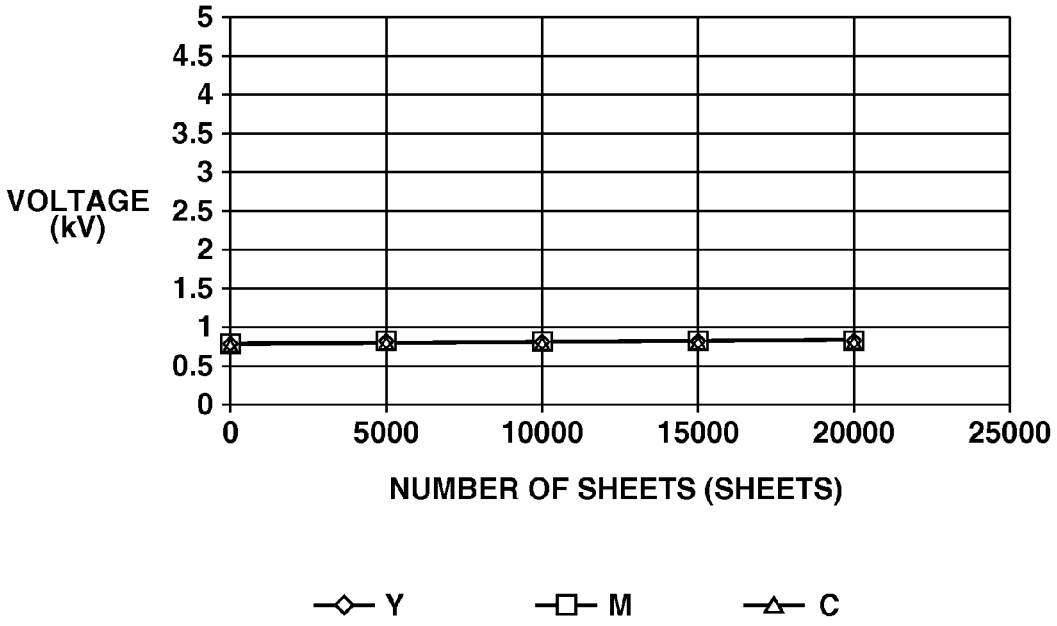
FIG. 8 is a graph illustrating an example of a transition of electrification of the intermediate transfer belt.

FIG. 8 illustrates changes in the primary transfer voltages at the Y, M, and C stations when the intermediate transfer belt 7 has a volume resistivity of $5.0\times10^{10}$ Ω·cm. None of the Y, M, and C stations shows a change in the primary transfer voltage even during continuous image formation.

Figure 9:
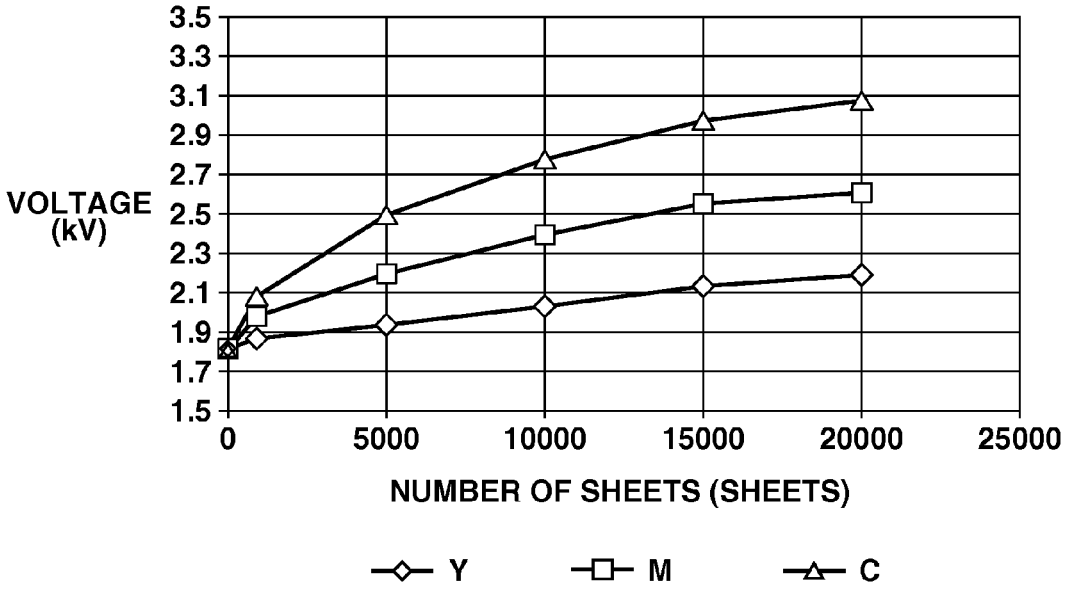
FIG. 9 is a graph illustrating another example of the transition of electrification of the intermediate transfer belt.

FIG. 9 illustrates changes in the primary transfer voltages at the Y, M, and C stations when the intermediate transfer belt 7 has a volume resistivity of $1.0\times10^{12}$ Ω·cm. A first characteristic observed in this case is that a difference occurs between the primary transfer voltage at the Y station where the primary transfer is performed first and the primary transfer voltage at the C station where the primary transfer is performed third. A second characteristic is that the primary transfer voltages rise gradually while continuous image formation is performed.

Figure 10:
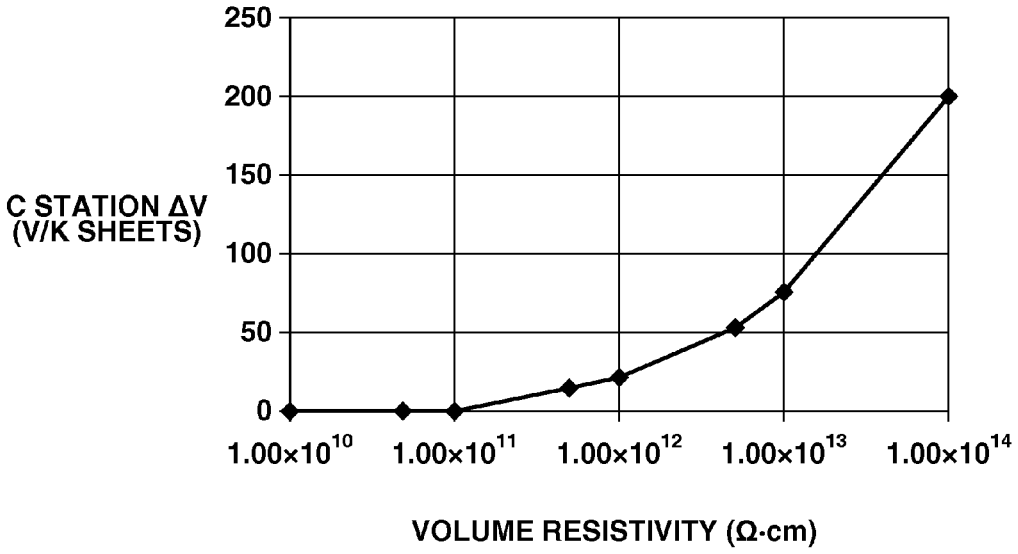
FIG. 10 is a graph illustrating an example of a relationship between the volume resistivity of the intermediate transfer belt and the degree of rise of a transfer voltage.

FIG. 10 illustrates a relationship between the actually obtained volume resistivity of the intermediate transfer belt 7 and the amount of rise (degree of rise) in voltage at the C station. FIG. 10 indicates that the primary transfer voltage during continuous sheet passing rises sharply if the volume resistivity of the intermediate transfer belt 7 exceeds $1.0\times10^{11}$ Ω·cm. An actual attenuation of the electrification charge of the intermediate transfer belt 7 between the primary transfer portions T1 of the adjoining image forming units S was calculated to determine a time constant. Assume that the intermediate transfer belt 7 has a constant permittivity s. In the present exemplary embodiment, the distance between the primary transfer portions T1 of the adjoining image forming units S is 120 mm, and the process speed is 350 mm/s (which corresponds to the circumferential speed of the intermediate transfer belt 7). If the voltage accumulated in the intermediate transfer belt 7 immediately after primary transfer is 100 V and the volume resistivity ρv of the intermediate transfer belt 7 is $9.0\times10^{10}$ Ω·cm or lower, the accumulated voltage attenuates to substantially 0 V in the primary transfer portion T1 of the next image forming unit S. However, if the volume resistivity ρv of the intermediate transfer belt 7 is $1.0\times10^{11}$ Ω·cm, the accumulated voltage attenuates to approximately 20 V. If the volume resistivity ρv is $1.0\times10^{12}$ Ω·cm, the accumulated voltage attenuates to approximately 50 V. If the volume resistivity ρv is $1.0\times10^{13}$ Ω·cm, the accumulated voltage attenuates to 92 V. This indicates that the attenuation amount of the electrification charge of the intermediate transfer belt 7 decreases sharply as the volume resistivity of the intermediate transfer belt 7 increases. In particular, if the volume resistivity ρv of the intermediate transfer belt 7 exceeds $1.0\times10^{11}$ Ω·cm, self attenuation becomes impossible. For example, if continuous image formation is performed in the full color mode, the electric resistances of the primary transfer portions T1 vary while several hundreds of images are continuously formed. For example, the optimum currents change in several minutes if the process speed is 80 sheets/min.

8. Control of Primary Transfer Voltages 8-1. Overview

In the present exemplary embodiment, the image forming apparatus 100 is capable of performing two types of control (described below) as a method for determining the primary transfer voltages.

One control includes applying a voltage to each of the primary transfer portions T1 and detecting a current value, detecting a voltage value when passing a certain value of current, and determining a required primary transfer voltage based on the voltage-current characteristic before starting image formation (hereinafter, such control is referred to as "normal ATVC"). In the present exemplary embodiment, the normal ATVC is performed during a pre-rotation operation which is a preparatory operation before the image formation.

The other control includes performing similar detection and feedback to those in the normal ATVC during an interval between sheets and correcting the primary transfer voltage to maintain an optimum primary transfer voltage while continuous image formation is performed on a plurality of transfer materials P (hereinafter, such control is referred to as "sheet-to-sheet ATVC"). The sheet-to-sheet ATVC can be performed in any region (timing) other than a region (timing) where a toner image is formed on the surface of a transfer material P.

Assume that the voltage applied to the primary transfer portion T1 is V1, the potential of the photosensitive drum 1 is Vd, and the current flowing through the primary transfer portion T1 is I1. The primary transfer current I1 flows due to a potential difference Vc (=V1−Vd) (hereinafter referred to as a "transfer contrast voltage") between the primary transfer portion T1 and the photosensitive drum 1. The electric resistance of the primary transfer portion T1 can thus be expressed as (V1−Vd)/I1. The transfer contrast voltage Vc is employed here because all the electric resistances of the potentials of the intermediate transfer belt 7, the primary transfer roller 5, and the photosensitive drum 1 that are applied to the primary transfer portion T1 contribute to the transfer of toner.

In the present exemplary embodiment, both the normal ATVC and the sheet-to-sheet ATVC are performed by the CPU 110.

8-2. Normal ATVC

First, the normal ATVC will be described with reference to the block diagram illustrated in FIG. 4, the flowchart illustrated in FIG. 11, and the table illustrated in Table 1. Table 1 illustrates a table for determining optimum primary transfer current values according to transfer contrast voltages Vc in each environment examined in advance. In the present exemplary embodiment, the temperature and humidity sensor (environment sensor) 190 serving as an environment detection unit obtains a relative humidity (hereinafter referred to as an "ambient humidity" or simply as a "humidity") based on the amount of moisture on the developing device 4 as the amount of moisture in the apparatus main body and a temperature outside the apparatus main body. In the table illustrated in Table 1, the optimum primary transfer current values are determined and set for each ambient humidity.

TABLE 1

| | | | Environmental category | | | | | | |
|---|---|---|---|---|---|---|---|---|---|
| | | | 1 | 2 | 3 | 4 | 5 | 6 | 7 |
| | | | Humidity | | | | | | |
| | | | 5% | 10% | 25% | 37% | 47% | 57% | 67% |
| Target current Ic1 [μA] (Target current corresponding to target current change transfer contrast voltage value Vc1 and lower) | Full color mode | Y | 50.0 | 50.0 | 50.0 | 50.0 | 45.0 | 40.0 | 40.0 |
| | | M | 50.0 | 50.0 | 50.0 | 50.0 | 45.0 | 40.0 | 40.0 |
| | | C | 50.0 | 50.0 | 50.0 | 50.0 | 45.0 | 40.0 | 40.0 |
| | | K | 55.0 | 55.0 | 55.0 | 55.0 | 50.0 | 45.0 | 45.0 |
| Target current Ic2 [μA] (Target current corresponding to target current change transfer contrast voltage value Vc2 and higher) | Full color mode | Y | 37.0 | 33.0 | 33.0 | 33.0 | 33.0 | 33.0 | 33.0 |
| | | M | 37.0 | 33.0 | 33.0 | 33.0 | 33.0 | 33.0 | 33.0 |
| | | C | 37.0 | 33.0 | 33.0 | 33.0 | 33.0 | 33.0 | 33.0 |
| | | K | 42.0 | 42.0 | 42.0 | 42.0 | 41.0 | 40.0 | 40.0 |
| Target current change transfer contrast voltage value [V] (Vc1 = V1 − Vd) | Full color mode | Y | 2400 | 2359 | 2323 | 2285 | 2278 | 2188 | 2150 |
| | | M | 2400 | 2359 | 2323 | 2285 | 2278 | 2188 | 2150 |
| | | C | 2400 | 2359 | 2323 | 2285 | 2278 | 2188 | 2150 |
| | | K | 2300 | 2259 | 2223 | 2185 | 2178 | 2088 | 2050 |
| Target current change transfer contrast voltage value [V] (Vc2 = V2 − Vd) | Full color mode | Y | 3800 | 3759 | 3723 | 3685 | 3678 | 3588 | 3550 |
| | | M | 3800 | 3759 | 3723 | 3685 | 3678 | 3588 | 3550 |
| | | C | 3800 | 3759 | 3723 | 3685 | 3678 | 3588 | 3550 |
| | | K | 3400 | 3359 | 3323 | 3285 | 3278 | 3188 | 3150 |

In step S101, the CPU 110 starts the normal ATVC. In step S102, the CPU 110 charges the photosensitive drums 1 by using the charging rollers 2 so that the photosensitive drums 1 have a predetermined potential. In step S103, the CPU 110 determines target currents I0 from the table illustrated in Table 1 based on the transfer contrast voltages applied just before the control and the ambient humidity during execution of the control.

As illustrated in Table 1, the target currents I0 in a region where the transfer contrast voltage value is from the initial value up to Vc1 (that is, a region where the transfer contrast voltage value is Vc1 or lower) are denoted by Ic1. The target currents I0 in a region where the transfer contrast voltage value is Vc2 and over (that is, a region where the transfer contrast voltage value is Vc2 or higher) are denoted by Ic2. If the transfer contrast voltage value falls between Vc1 and Vc2 (that is, the transfer contrast voltage value is higher than Vc1 and lower than Vc2), the target currents I0 are determined by linear interpolation of the voltage-current characteristic of Vc1 and Ic1 and that of Vc2 and Ic2. For the purpose of the subsequent description, the region where the transfer contrast voltage value is from the initial value up to Vc1 is referred to as a "region 1", the region where the value is over Vc1 up to (Vc1+Vc2)/2 as a "region 2", the region where the value is over (Vc1+Vc2)/2 and under Vc2 as a "region 3," and the region where the value is Vc2 and over as a "region 4".

In step S104, a constant current control high-voltage substrate of the primary transfer bias control unit 114 outputs constant current voltages so that the constant target currents I0 flow. In step S105, a voltage detection circuit of the primary transfer bias control unit 114 detects the values of the applied voltages for a single turn of the primary transfer rollers 5, and determines and stores the averages of the values (initial voltages V0) into the memory 111. In step S106, the CPU 110 determines difference voltages ΔVx to be used in the next step from the detected initial voltages V0. The suffix "x" of the difference voltages ΔVx indicates the number of the corresponding region. In the case of the region 1, the difference voltages are denoted by ΔV1. In the case of the region 2, the difference voltages are denoted by ΔV2. The difference voltages ΔVx are determined so as to be ΔV1=ΔV in the region 1, ΔV2=ΔV×3 in the region 2, ΔV3=ΔV×4 in the region 3, and ΔV4=ΔV×6 in the region 4.

In step S107, voltages V1 (=V0−ΔVx) obtained by subtracting the difference voltages ΔVx from the initial voltages V0 are applied to the respective primary transfer rollers 5 for a single turn. At this time, a current value detection circuit of the primary transfer bias control unit 114 detects the values of the currents flowing through the primary transfer rollers 5, and determines and stores the averages of the values into the memory 111. In step S108, voltages V2 (=V0+ΔVx) obtained by adding the difference voltages ΔVx to the initial voltages V0 are applied to the respective primary transfer rollers 5 for a single turn. The current value detection circuit of the primary transfer bias control unit 114 detects the values of the currents flowing through the primary transfer rollers 5, and determines and stores the averages of the values into the memory 111. The average current values with the application of V1 are denoted by I1. The average current values with the application of V2 are denoted by I2.

In step S109, the CPU 110 determines final target currents It in the current normal ATVC control based on the initial voltages V0 determined in step S105 and the table illustrated in Table 1. In step S110, the CPU 110 calculates voltage values Vt for the final target currents It determined by the current normal ATVC control, based on the obtained linear expressions of the relationship of V1, V2, I1, and I2 (voltage-current characteristic). In such a manner, the primary transfer voltages to be applied in constant voltage control during the subsequent image formation are determined. The target currents It serve as target current values during correction at an interval between sheets to be described below.

The CPU 110 stores the determined target currents It and target voltage values Vt of the image forming units SY, SM, SC, and SK as backup values It1, It2, It3, and It4, and Vt1, Vt2, Vt3, and Vt4, respectively. The CPU 110 applies the target voltages Vt1, Vt2, Vt3, and Vt4 as the primary transfer voltages when the image formation is started.

As described above, ΔVx is changed region by region, or more specifically, changed by multiplication of a coefficient according to the electric resistance of the primary transfer portion T1. The reason is that it is considered that the gradient of the voltage-current (V-I) curve tends to decrease as the electric resistance increases. As a result, the linear interpolation of V1, V2, I1, and I2 can be calculated without a reduction in accuracy.

8-3. Sheet-to-Sheet ATVC

Next, the sheet-to-sheet ATVC will be described. When image formation is continuously performed, the primary transfer voltages may gradually change. For example, if the outside air temperature is low, the ion-conductive intermediate transfer belt 7 has a high volume resistivity. However, if the main body of the image forming apparatus 100 is powered on and the temperature of the fixing device 11 increases and/or motors are actuated, the temperature inside the apparatus main body gradually rises and the volume resistivity of the intermediate transfer belt 7 decreases accordingly. Therefore, the application voltages Vt required to pass optimum current values It become lower than the application voltages Vt initially determined. Meanwhile, the ion-conductive intermediate transfer belt 7 increases in electric resistance if continuously energized for a long period of time. Further, in the present exemplary embodiment, as described above, a volume resistivity exceeding $1.0\times10^{12}$ Ω·cm makes self attenuation impossible. For example, if continuous sheet passing is performed in the full color mode, the electric resistances of the primary transfer portions T1 vary in the course of forming several hundreds of images. If the image formation is continuously performed after the stabilization of the temperature inside the apparatus main body, the application voltages Vt required to pass optimum current values It increase with the increasing number of formed images. In such a case, the optimum current values It are not able to be obtained unless the application voltages Vt are increased. As described above, the charge amounts of the primary transfer portions T1 fail to attenuate and increase between the primary transfer portions T1 of the adjoining image forming units S. The application voltages Vt therefore need to be corrected during the image formation by the image forming units S.

In the present exemplary embodiment, the CPU 110 applies a voltage to each of the primary transfer portions T1 and detects a current value at a timing (interval between sheets in the present exemplary embodiment) when none of images to be formed on transfer materials P is formed. If the current value deviates from an optimum current value by a predetermined value or more, the CPU 110 performs control to add or subtract a predetermined correction voltage (correction amount) ΔVt.

Figure 12:
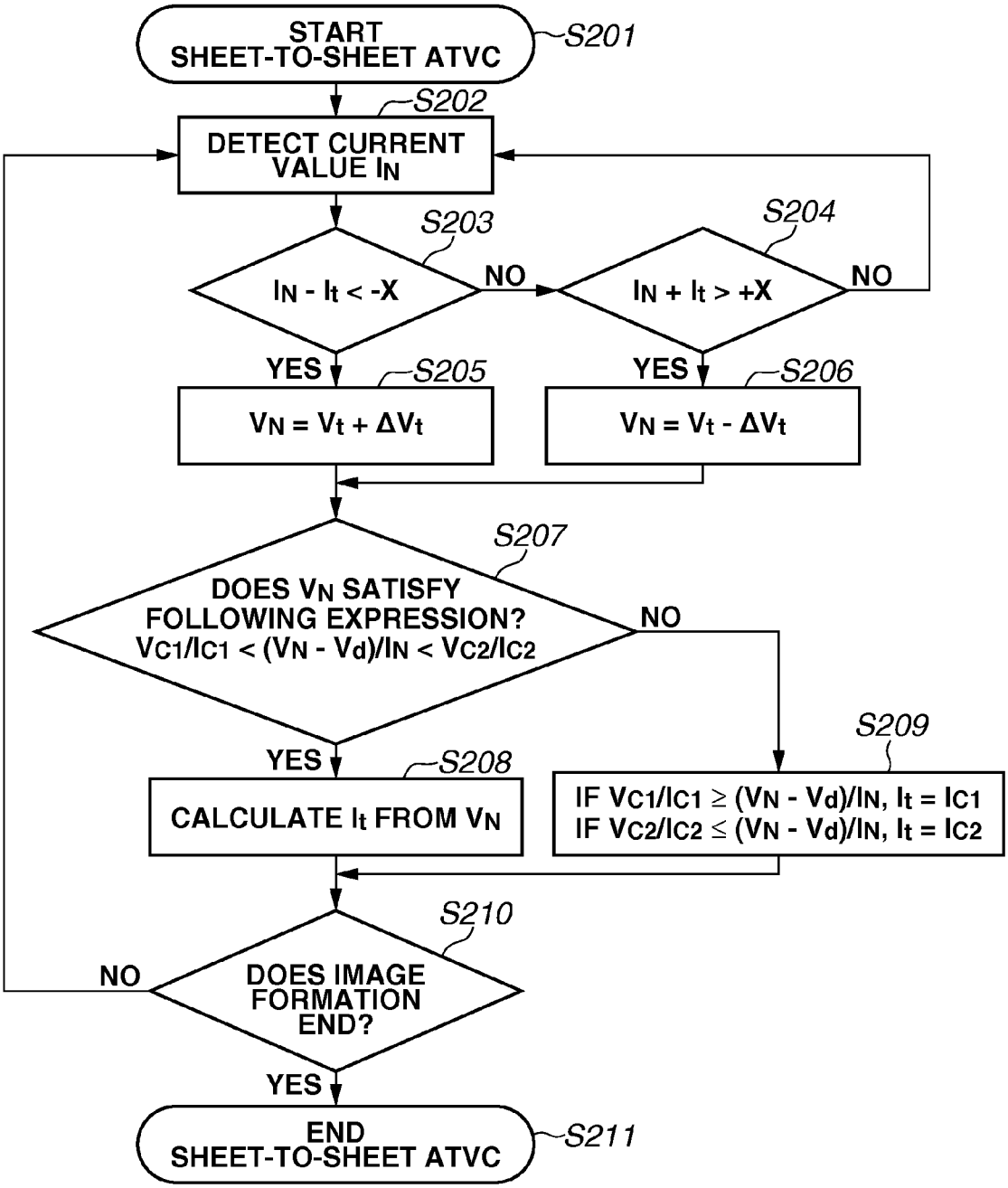
FIG. 12 is a flowchart illustrating an example of sheet-to-sheet ATVC.

FIG. 12 illustrates the flowchart of the sheet-to-sheet ATVC. In step S201, the CPU 110 starts the sheet-to-sheet ATVC. In step S202, the CPU 110 stores, into the memory 111, a current value $I_N$ detected at an interval of a predetermined number N of sheets. In steps S203 and S204, the CPU 110 determines whether the detected current value $I_N$ is higher than or lower than the target current It currently backed up. In steps S205 and S206, the CPU 110 corrects Vt into $V_N$ by adding or subtracting the correction amount ΔVt. For example, if $I_N$ is smaller than It (YES in step S203), then in step S205, the CPU 110 adds the correction amount ΔVt to Vt to determine the corrected voltage value $V_N$. If $I_N$ is greater than It (YES in step S204), then in step S206, the CPU 110 subtracts the correction amount ΔVt from Vt to determine the corrected voltage value $V_N$.

The value of X in steps S203 and S204 may be zero. Alternatively, a predetermined numerical value may be set to X so that the correction is not performed within the range of the target current It±X pA.

In step S207, the CPU 110 determines whether the value obtained by dividing the corrected transfer contrast voltage by the detected current value $I_N$ falls within a range where variable control needs to be performed on the target current It determined based on the table illustrated in Table 1. If the value is determined to fall within the region where the variable control needs to be performed (YES in step S207), then in step S208, the CPU 110 calculates, changes, and determines the target current It based on the transfer contrast voltage $V_N$–Vd and the linear interpolation of (Vc1,Ic1) and (Vc2,Ic2) on the table illustrated in Table 1. If the value is determined to not fall within the range where the variable control needs to be performed in step S207 (NO in step S207), then in step S209, the CPU 110 determines the target current It to be Ic1 or Ic2 according to the value of the transfer contrast voltage $V_N$–Vd.

The CPU 110 switches to the primary transfer voltage value changed and determined by the sheet-to-sheet ATVC between the Nth and (N+1)th sheets. The CPU 110 similarly performs the next sheet-to-sheet ATVC by using detected current values $I_N$ at the (N+2)th to (2N+2)th sheets. The CPU 110 continues the correction until the continuous image formation ends. The interval of the number of sheets N has only to be such that a value equivalent to an average value of the detected current values $I_N$ during normal image formation can be monitored. In the present exemplary embodiment, N is set to five. The current value $I_N$ is detected at eight points between sheets. An average value of a total of 40 points is used.

The CPU 110 may perform the normal ATVC by interrupt control during an interval between sheets after a predetermined number of sheets, e.g., after 400 A4-equivalent sheets are passed. However, in the present exemplary embodiment, the CPU 110 performs the normal ATVC during an interval between sheets in an interrupt manner if the detected current value $I_N$ of the sheet-to-sheet ATVC exceeds the range of the target current value It±5 μA. This can immediately restore the target current value It if the actually-applied current value deviates from the target current value It. This can also preclude unnecessary normal ATVC if the actually-applied current value does not deviate from the target current value It. As a result, a desired target current value It can be obtained without a reduction in productivity. The interruption timing of the normal ATVC and other types of control (for example, image density adjustment control and color shift correction control) may be performed in a synchronized manner. The result in the sheet-to-sheet ATVC can thus be reflected in the determination of the execution timing of the normal ATVC.

Figure 11:
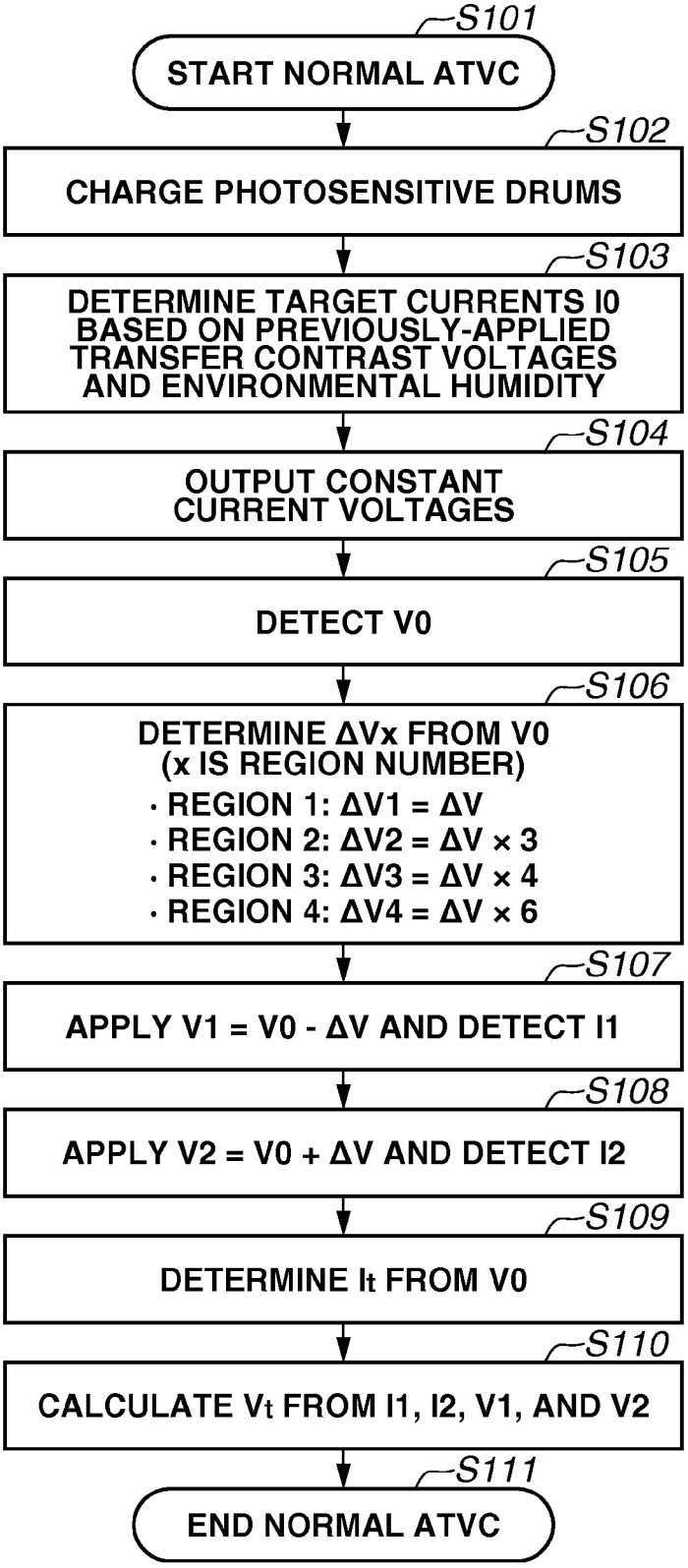
FIG. 11 is a flowchart illustrating an example of normal active transfer voltage control (ATVC).

As described above, the transfer contrast voltage applied just before the normal ATVC in the processing of step S103 in the flow of the normal ATVC illustrated in FIG. 11 is the transfer contrast voltage corrected by the sheet-to-sheet ATVC in a case where image formation is performed just before the normal ATVC. Thus, using the transfer contrast voltage applied just before the normal ATVC enables interpolation calculation from a V-I curve that is closer to the target current value It in the processing of step S110 in the flow of the normal ATVC illustrated in FIG. 11, whereby the primary transfer voltage can be accurately determined.

As described above, according to the present exemplary embodiment, in the normal ATVC, the target current value It and the application voltage value are determined regardless of the region of the transfer contrast voltage value.

In contrast, in the sheet-to-sheet ATVC, the target current value It is variably controlled and the application voltage is corrected to the target current value It only in the region where the transfer contrast voltage value is higher than Vc1 and lower than Vc2. This region corresponds to the range where the volume resistivity of the intermediate transfer belt 7 is higher than $1\times10^{10}$ Ω·cm and lower than $1\times10^{12}$ Ω·cm. In the region, the intermediate transfer belt 7 cannot attenuate by itself and a charge-up accelerates. The target current value It thus needs to be variably controlled by the sheet-to-sheet ATVC during continuous image formation so as to be controlled to an optimum value when needed.

In the sheet-to-sheet ATVC, in the region where the transfer contrast voltage value is Vc1 or lower, the application voltage is corrected to the target current value It determined by the normal ATVC but the target current value It is not changed. This region corresponds to the range where the volume resistivity of the intermediate transfer belt 7 is $1\times10^{10}$ Ω·cm or lower. In the region, a memory is prevented from occurring in the photosensitive drum 1 due to the target current value It being set too high by variably controlling the target current value It according to the electric resistance of the primary transfer portion T1 during continuous image formation.

In the sheet-to-sheet ATVC, in the region where the transfer contrast voltage value is Vc2 or higher, the application voltage is corrected to the target current value It determined by the normal ATVC but the target current value It is not changed. This region corresponds to the range where the volume resistivity of the intermediate transfer belt 7 is $1\times10^{12}$ Ω·cm or higher. In the region, a defect due to an insufficient transfer current such as deteriorating graininess is prevented from occurring due to the target current value IT being set too low by variably controlling the target current value IT according to the electric resistance of the primary transfer portion T1 during continuous image formation.

As described above, in the present exemplary embodiment, the image forming apparatus 100 includes the detection unit (the primary transfer bias control unit in the present exemplary embodiment) 114 that detects the values (transfer contrast voltages) correlated with the electric resistances of the primary transfer portions T1. The image forming apparatus 100 also includes the control unit (the CPU in the present exemplary embodiment) 110 that controls the voltages (primary transfer voltages) to be applied to the primary transfer members 5 for primary transfer in continuous image formation on a plurality of transfer materials P, before performing the continuous image formation. The image forming apparatus 100 further includes the correction unit (the CPU in the present exemplary embodiment) 110 that corrects the primary transfer voltages while performing the continuous image formation on the plurality of transfer materials P. The control unit 110 determines, based on the detection results by the detection unit 114, the target values of the currents (target current values) to be supplied to the primary transfer portions 5 for the primary transfer in the continuous image formation, and then controls the primary transfer voltages according to the target values. The correction unit 110 is also capable of performing the following first and second modes. In the first mode, the correction unit 110 controls the primary transfer voltages according to the target values determined by the control unit 110. In the second mode, the correction unit 110 changes the target values determined by the control unit 110 based on the detection results by the detection unit 114, and controls the primary transfer voltages according to the changed target values.

The correction unit 110 selectively performs the first mode and the second mode in the following manner. If the electric resistances indicated by the detection results of the detection unit 114 are a first value or lower, or a second value, which is higher than the first value, or higher, the correction unit 110 performs the first mode. On the other hand, if the electric resistances indicated by the detection results of the detection unit 114 are higher than the first value and lower than the second value, the correction unit 110 performs the second mode. In particular, in the present exemplary embodiment, the correction unit 110 performs voltage correction if a difference between a target value and the value of the current being supplied to the primary transfer portion T1 exceeds a predetermined range. The control unit 110 can determine the execution timing of the voltage control based on the result of a comparison by the correction unit 110 between the target value and the value of the current being supplied to the primary transfer portion T1. In such a case, if the correction unit 110 detects that the difference between the target value and the value of the current being supplied to the primary transfer portion T1 exceeds the predetermined range, the correction unit 110 can perform the voltage control by interrupt control.

As described above, according to the present exemplary embodiment, even if the electric resistance of the intermediate transfer belt 7 changes during continuous image formation, appropriate primary transfer current values can be accordingly supplied to maintain favorable transferability.

Up to this point, a specific exemplary embodiment of the present invention has been described. However, the present invention is not limited to the foregoing exemplary embodiment.

For example, in the foregoing exemplary embodiment, the normal ATVC is performed during a pre-rotation operation, and the sheet-to-sheet ATVC is performed at an interval between sheets. However, the normal ATVC may be performed in any other timing during a non-image forming operation other than the image forming operation during which an output image to be transferred and output to a transfer material P is being formed. The image forming operation refers to a period in which formation of an electromagnetic latent image, development, primary transfer, and secondary transfer are performed for an output image. The non-image forming operation refers to any other period. Examples of the non-image forming operation include a pre-multi-rotation operation, a pre-rotation operation, a sheet-to-sheet operation, and a post-rotation operation. The pre-multi-rotation operation is a preparatory operation performed upon power-on of the image forming apparatus 100. The pre-rotation operation is a preparatory operation between when an image formation start instruction is input and when the image formation is actually started. The sheet-to-sheet operation corresponds to an interval between one transfer material P and another when forming images on a plurality of transfer materials P. The post-rotation operation is an arrangement operation (preparatory operation) after the end of the image formation. For example, if a plurality of jobs (a series of image forming operations on one or a plurality of transfer materials P by a single image formation start instruction) is on standby, the sheet-to-sheet ATVC can be performed during the post-rotation operation after a job and before the next job. Furthermore, performing the normal ATVC before continuous image formation on a plurality of transfer materials P refers not only to performing the normal ATVC before the job of the continuous image formation. For example, in the case of interrupting a job to perform the normal ATVC by interrupt control, the normal ATVC is performed before the continuous image formation of the job that is resumed after the end of the normal ATVC.

The primary transfer members and the secondary transfer member are not limited to roller-shaped ones. Transfer members of any configuration may be used. Examples include plate-like (blade-like), sheet-like, brush-like, and block-like ones that are arranged to make contact with and frictionally slide over the moving intermediate transfer member.

In the foregoing exemplary embodiment, the intermediate transfer member has been described as an intermediate transfer belt 7 constituting an endless belt. However, the intermediate transfer member is not limited thereto. For example, the intermediate transfer member may be an intermediate transfer drum having a drum shape formed by stretching a sheet, which is made of similar materials to those of the intermediate transfer belt 7 according to the foregoing exemplary embodiment, over a frame body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107613, filed May 23, 2014, which is hereby incorporated by reference herein in its entirety.

What is claimed is:

1. An image forming apparatus comprising:

an image bearing member configured to bear a toner image thereon;

a movable intermediate transfer member configured to temporarily bear the toner image, wherein the toner image is transferred from the image bearing member onto the intermediate transfer member in a transfer portion and then is transferred onto a recording material;

a transfer member configured to electrostatically transfer the toner image formed on the image bearing member onto the intermediate transfer member in the transfer portion;

a power supply configured to apply a voltage to the transfer member;

a detection member configured to detect a current flowing through the transfer member during the application of the voltage to the transfer member;

an execution portion configured to execute a test mode during preparatory period before an image forming operation, wherein the execution portion determines a target voltage in the test mode so that an output of the detection member becomes a target current when the toner image to be transferred to the recording material passes through the transfer portion;

a setting portion configured to set the target current, based on the target voltage determined in the test mode, (a) to a first current when an absolute value of the target voltage is smaller than or equal to a first voltage, wherein the first current is a constant value regardless of the target voltage, (b) to a second current when the absolute value of the target voltage is larger than or equal to a second voltage which is larger than the first voltage, wherein the second current is a constant value regardless of the target voltage and an absolute value of the second current is smaller than an absolute value of the first current, (c) to a third current when an absolute value of the target voltage is larger than the first voltage and smaller than the second voltage, wherein an absolute value of the third current is smaller than the absolute value of the first current and larger than the absolute value of the second current, and wherein the third current is set so that, when an absolute value of the target voltage is a first value, an absolute value of the third current is smaller than the absolute value of the third current when the absolute value of the target voltage is smaller than the first value.

2. The image forming apparatus according to claim 1, wherein the intermediate transfer member contains an ion conductive agent.

3. The image forming apparatus according to claim 1, wherein the intermediate transfer member includes a plurality of layers having a layer on an outer peripheral side with a layer hardness that is lower than a layer hardness of a layer of the plurality of layers on an inner peripheral side.

4. The image forming apparatus according to claim 1, wherein, during the test mode and while the target current flows, the execution portion determines a target voltage based on each current detected by the detection member when applied with plural currents.

5. The image forming apparatus according to claim 1, further comprising a memory configured to previously store a correspondence relation between the target voltage and the first to third current values, wherein the setting portion sets the target current based on a reference result between the target voltage and the memory.

6. The image forming apparatus according to claim 5, further comprising an environment sensor configured to detect an environmental moisture amount nearby the image forming apparatus, wherein the memory previously stores the correspondence relation having correlation with the environmental moisture amount, and wherein the setting portion sets the target current based on the correspondence relation between a detection result of the environment sensor, the target voltage, and the memory.

7. The image forming apparatus according to claim 1, further comprising an electrostatic cleaning member configured to electrostatically clean a residual toner attached to the intermediate transfer member, wherein the electrostatic cleaning member is applied with a voltage having a polarity that is the same polarity as a polarity of a voltage applied to the transfer member.

8. The image forming apparatus according to claim 1, wherein the intermediate transfer member is an intermediate transfer belt having a rubber layer having ion conductivity.

9. The image forming apparatus according to claim 8, wherein, after energizing the intermediate transfer belt with energization so that a value obtained by multiplying (i) an amount of energization per unit area and (ii) cumulative time is 30.0 ampere per square meter ($A/m^2$) in a prescribed polarity, a volume resistivity of the intermediate transfer belt increases by one digit or more in volume resistivity of the intermediate transfer belt as compared to before the intermediate transfer belt is energized.

10. The image forming apparatus according to claim 8, wherein the intermediate transfer belt includes a base layer formed by resin, the rubber layer, and a surface layer.

11. The image forming apparatus according to claim 1, wherein, in a case where a volume resistivity of the intermediate transfer belt is equal to or less than $1\times10^{10}$ ohm centimeter (Ω·cm), the setting portion sets the target current as the first current, and wherein, in a case where the volume resistivity of the intermediate transfer belt is larger than $1\times10^{12}$ (Ω·cm), the setting portion sets the targets current as the second current.

12. The image forming apparatus according to claim 1, further comprising an electrifying member configured to electrify the image bearing member into a predetermined potential, wherein the setting portion sets the target current based on the target voltage determined in the test mode and the electric potential of the image bearing member.

* * * * *